US009121203B2

(12) United States Patent
Muramatsu et al.

(10) Patent No.: US 9,121,203 B2
(45) Date of Patent: Sep. 1, 2015

(54) VEHICLE DOOR FIXING APPARATUS AND FIXED WEDGE OF SAME

(75) Inventors: Akira Muramatsu, Chiryu (JP); Kosuke Tsukamoto, Chiryu (JP); Yoshiki Odaka, Kariya (JP); Takahiro Sogawa, Nakagawa-gun (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 276 days.

(21) Appl. No.: 13/594,086

(22) Filed: Aug. 24, 2012

(65) Prior Publication Data

US 2013/0047374 A1 Feb. 28, 2013

(30) Foreign Application Priority Data

Aug. 25, 2011 (JP) ..... 2011-184014
Dec. 27, 2011 (JP) ..... 2011-286721

(51) Int. Cl.

| | |
|---|---|
| ***E05B 15/02*** | (2006.01) |
| ***E05B 77/36*** | (2014.01) |
| ***E05C 17/54*** | (2006.01) |
| ***E05B 85/04*** | (2014.01) |
| *E05B 15/00* | (2006.01) |
| *E05B 79/02* | (2014.01) |

(52) U.S. Cl.

CPC ..... *E05B 77/36* (2013.01); *E05B 85/045* (2013.01); *E05C 17/54* (2013.01); *E05B 15/022* (2013.01); *E05B 79/02* (2013.01); *Y10T 16/61* (2015.01)

(58) Field of Classification Search

CPC ..... E05C 17/54
USPC ..... 292/340, 342, 343
See application file for complete search history.

(56) References Cited

U.S. PATENT DOCUMENTS

| | | | | | |
|---|---|---|---|---|---|
| 1,893,639 | A | * | 1/1933 | Stutson | 16/86 B |
| 1,922,298 | A | * | 8/1933 | Jones | 292/342 |
| 2,205,614 | A | * | 6/1940 | Bashe | 292/342 |
| 3,675,955 | A | * | 7/1972 | Hajduk | 217/65 |
| 3,831,988 | A | * | 8/1974 | Stelma | 292/302 |
| 4,165,112 | A | * | 8/1979 | Kleefeldt | 292/216 |
| 4,192,039 | A | * | 3/1980 | Haberle et al. | 16/86 B |
| 5,215,342 | A | * | 6/1993 | Yuge et al. | 292/340 |

(Continued)

FOREIGN PATENT DOCUMENTS

| | | | |
|---|---|---|---|
| DE | 1036482 | * | 8/1958 |
| JP | S62-151377 | | 9/1987 |

(Continued)

OTHER PUBLICATIONS

Office Action issued Mar. 17, 2015 in corresponding Japanese Patent Application No. 2011-184014, and English translation thereof (5 pages).

*Primary Examiner* — Carlos Lugo
(74) *Attorney, Agent, or Firm* — Buchanan Ingersoll & Rooney PC

(57) ABSTRACT

A vehicle door fixing apparatus includes a fixed wedge configured to be fixed to one of a vehicle body panel and a door panel, and a wedge device configured to be fixed to the other of the vehicle body panel and the door panel, the fixed wedge including an attachment member configured to be attached to the vehicle body panel or the door panel, and a wedge member provided to be pressure contactable with the wedge device and being attachable and removable relative to the attachment member, the wedge member forming a design surface of the fixed wedge.

6 Claims, 23 Drawing Sheets

(56) References Cited

U.S. PATENT DOCUMENTS

| | | | | |
|---|---|---|---|---|
| 5,992,927 | A * | 11/1999 | Scroggie | 296/207 |
| 6,345,849 | B1 * | 2/2002 | Yen | 292/343 |
| 6,557,913 | B1 * | 5/2003 | Kunst | 292/340 |
| 7,025,395 | B2 * | 4/2006 | Fisher | 292/340 |
| 7,308,731 | B2 * | 12/2007 | Schubring et al. | 16/86 R |
| 2012/0112474 | A1 | 5/2012 | Muramatsu et al. | |
| 2012/0112477 | A1 | 5/2012 | Muramatsu et al. | |
| 2012/0161454 | A1 | 6/2012 | Muramatsu et al. | |

FOREIGN PATENT DOCUMENTS

| | | | |
|---|---|---|---|
| JP | 1-43298 | Y2 | 12/1989 |
| JP | H05-086751 | A | 4/1993 |
| JP | 2003-013640 | A | 1/2003 |
| WO | WO 2011/105328 | A1 | 9/2011 |

* cited by examiner

VEHICLE DOOR FIXING APPARATUS AND FIXED WEDGE OF SAME

CROSS REFERENCE TO RELATED APPLICATIONS

This application is based on and claims priority under 35 U.S.C. §119 to Japanese Patent Applications 2011-184014, filed on Aug. 25, 2011, and 2011-286721, filed on Dec. 27, 2011, the entire contents of which are incorporated herein by reference.

TECHNICAL FIELD

This disclosure generally relates to a vehicle door fixing apparatus and a fixed wedge of the same.

BACKGROUND DISCUSSION

A known vehicle door fixing apparatus is disclosed in JPH1-43298Y (hereinafter referred to as Reference 1). As illustrated in FIG. 36, the known vehicle door fixing apparatus disclosed in Reference 1 is provided with a fixed wedge 52 including an inclined surface 51 and fixedly attached to a door panel D. The known vehicle door fixing apparatus is also provided with a movable wedge 54 including an inclined surface 53 being in contact with the inclined surface 51 in a state where a vehicle door is closed. The movable wedge 54 is provided at a vehicle body panel B so as to move in a reciprocating sliding manner. The movable wedge 54 is biased by a spring 55 so as to be pressed against the fixed wedge 52 when the vehicle door is closed; thereby, the door is pushed toward a hinge of the vehicle door. As a result, rattles or vibrations of the vehicle door are restricted. In addition, the movable wedge 54 is slidably provided on an end surface (upper surface) of a base plate 56 fixedly attached to the vehicle body panel B. The end surface of the base plate 56 faces the vehicle door (the fixed wedge 52).

According to the vehicle door fixing apparatus disclosed in Reference 1, the fixed wedge 52 is directly fixed to the door panel D. In addition, for example, in a case where the fixed wedge 52 is formed by a single component, the fixed wedge 52 may not be easily or simply replaced with the new fixed wedge 52. In particular, for example, in a case where the fixed wedge 52 is welded to the door panel D, the fixed wedge 52 welded to the door panel D may not be substantially replaced with the new fixed wedge 52. As a result, for example, in the case of a modification of a material for the movable wedge 54, a frictional engagement force between the movable wedge 54 and the fixed wedge 52 may not be easily adjusted, that is, fixing strength of the vehicle door relative to a vehicle body may not be easily adjusted.

A need thus exists for a vehicle door fixing apparatus and a fixed wedge of the same which are not susceptible to the drawback mentioned above.

SUMMARY

According to an aspect of this disclosure, a vehicle door fixing apparatus includes a fixed wedge configured to be fixed to one of a vehicle body panel and a door panel, and a wedge device configured to be fixed to the other of the vehicle body panel and the door panel, the fixed wedge including an attachment member configured to be attached to the vehicle body panel or the door panel, and a wedge member provided to be pressure contactable with the wedge device and being attachable and removable relative to the attachment member, the wedge member forming a design surface of the fixed wedge.

According to another aspect of the disclosure, a fixed wedge configured to be fixed to one of a vehicle body panel and a door panel, the fixed wedge includes an attachment member configured to be attached to the vehicle body panel or the door panel, and a wedge member provided to be pressure contactable with a wedge device configured to be arranged at the other of the vehicle body panel and the door panel, the wedge member being attachable and removable relative to the attachment member and forming a design surface of the fixed wedge.

According to still another aspect of the disclosure, a vehicle door fixing apparatus includes a fixed wedge fixed to one of a vehicle body panel and a door panel, and a wedge device fixed to the other of the vehicle body panel and the door panel, the fixed wedge including an attachment member attached to the vehicle body panel or the door panel, and a wedge member provided to be attachable and removable relative to the attachment member and engaging with the wedge device.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 1:
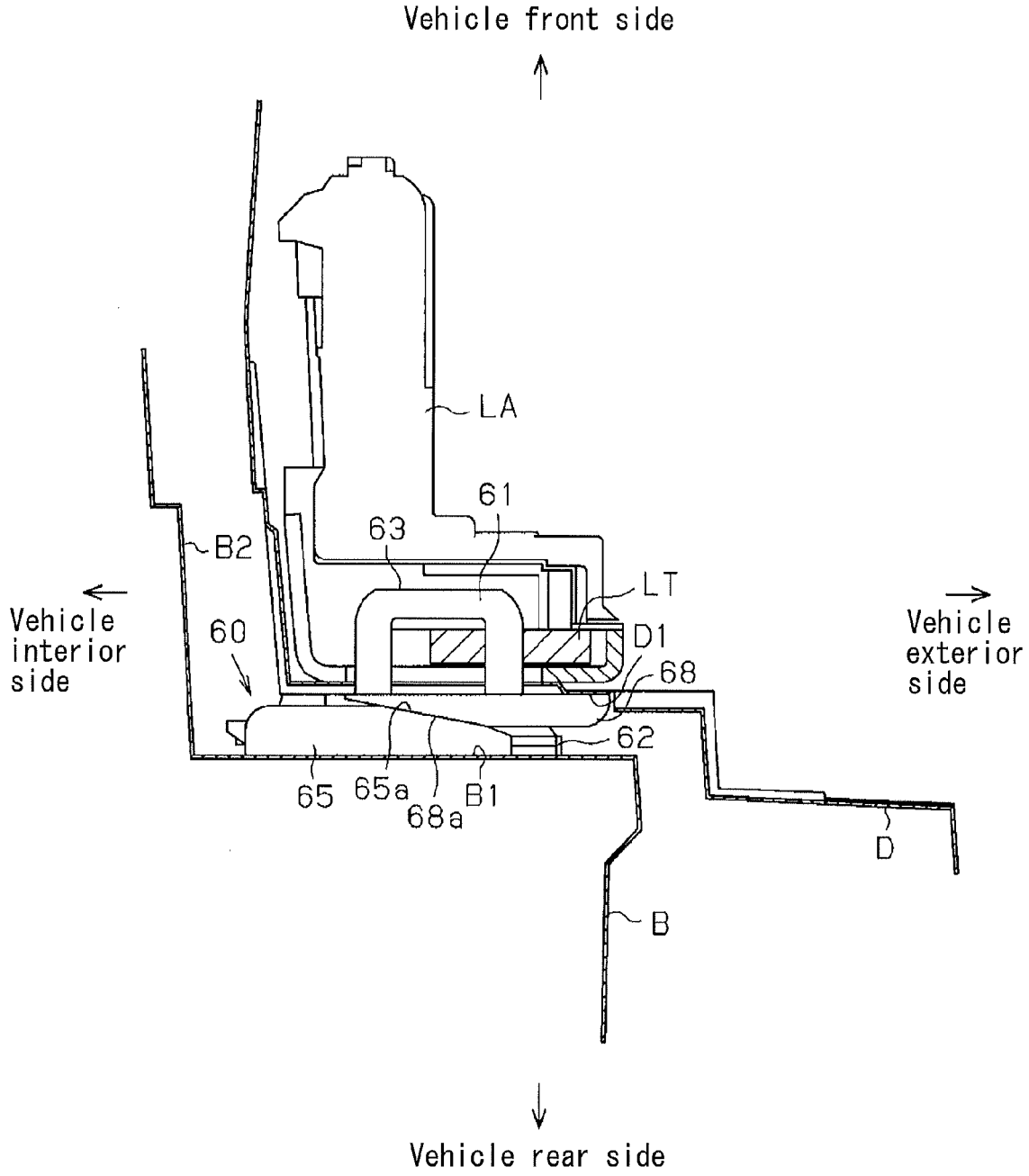
FIG. 1 is a cross-sectional side view of a vehicle door fixing apparatus according to a first embodiment disclosed here.

A first embodiment of this disclosure will be explained as follows with reference to the illustrations of FIGS. 1 to 25. A vehicle door fixing apparatus according to the first embodiment is applied to a side door positioned at a front right side of a vehicle including a vehicle body configured to be completely open to air or at a front right side of a vehicle including a convertible vehicle body. As illustrated in FIG. 1, a vehicle body panel B (a side member outer panel) forms an end surface B1 and a flange B2. The end surface B1 extending in a width direction of the vehicle (the width direction of the vehicle will be hereinafter referred to as a vehicle width direction) and facing a front side of the vehicle is positioned at a rear portion of an opening (a door opening) formed in a side surface of the vehicle body of the vehicle in the vehicle width direction. The flange B2 extends from an interior end of the end surface B1 in the vehicle width direction (in a horizontal direction of FIG. 1), to the front side of the vehicle. In addition, a movable wedge device 60 (serving as a wedge device) including a door lock striker 61 and a movable wedge 65 is provided at the end surface B1.

Meanwhile, a door panel D (a door inner panel) of the vehicle door forms an end surface D1. The door panel D opens and closes the door opening along the vehicle width direction. The end surface D1 extending in the vehicle width direction is positioned at a front side of the end surface B1 so as to face the end surface B1 of the vehicle body panel B. A fixed wedge 68 is fixedly attached to the end surface D1 of the door panel D so as to be provided at a position facing the movable wedge device 60 when the vehicle door is closed. In addition, a door lock assembly LA including a door latch LT is assembled on the door panel D together with the fixed wedge 68 so as to be positioned at an opposite side of the fixed wedge 68 relative to the door panel D. The door latch LT engages with and disengages from the door lock striker 61.

Figure 2:
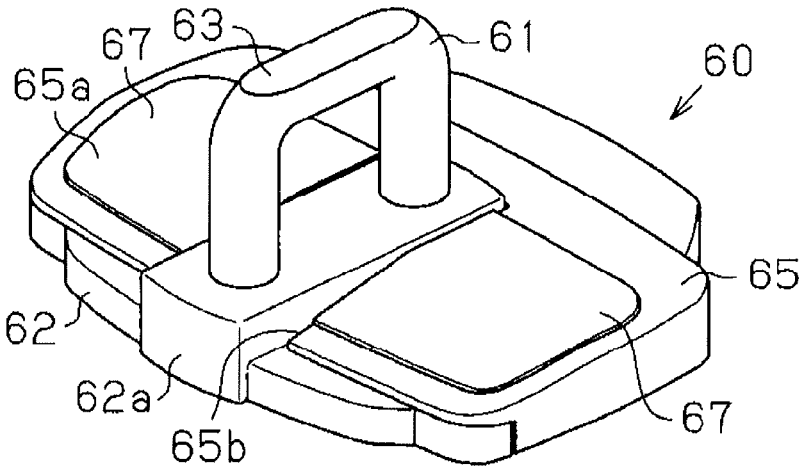
FIG. 2 is a perspective view of a movable wedge device provided at the vehicle door fixing apparatus according to the first embodiment disclosed here.
Figure 3:
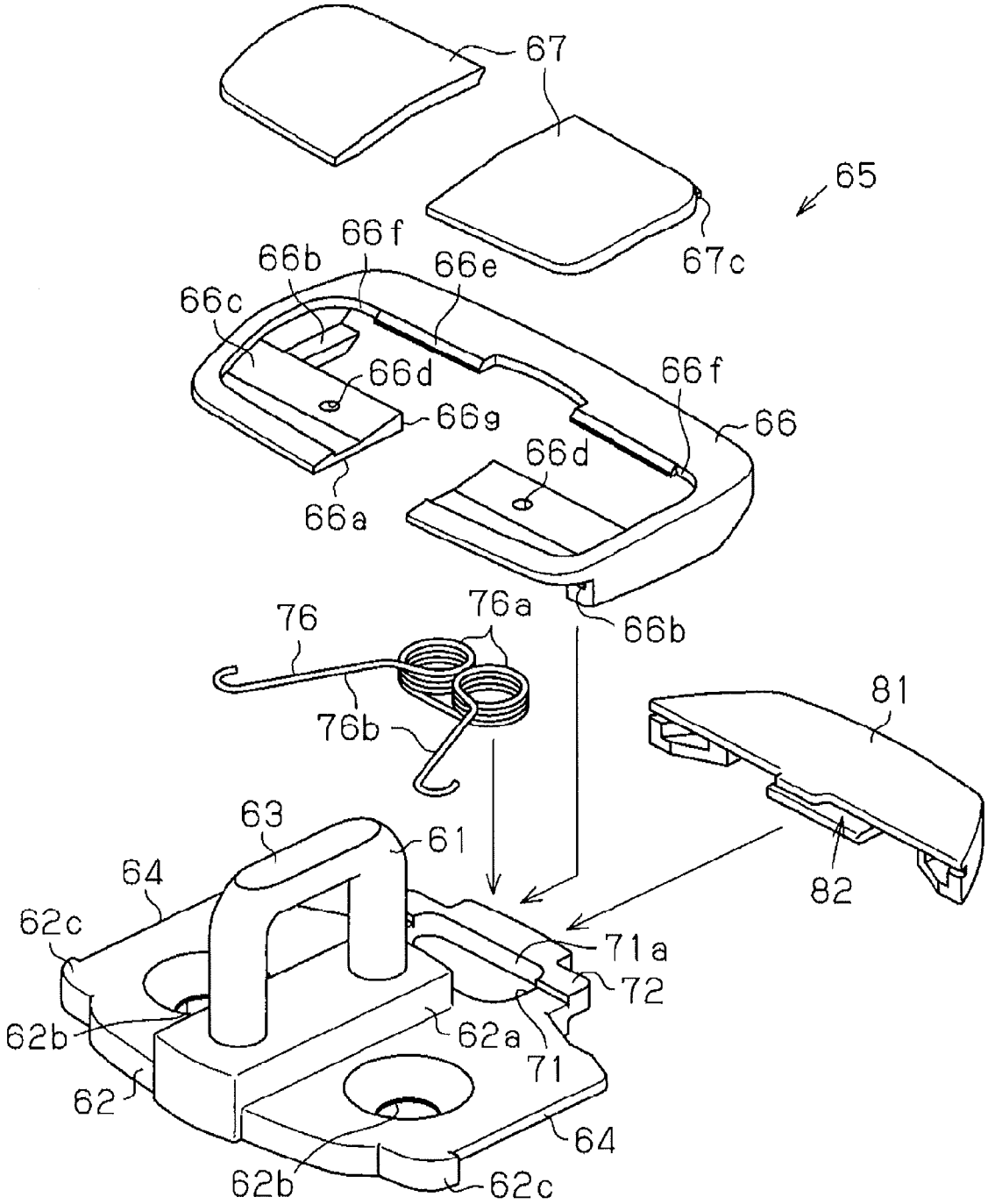
FIG. 3 is an exploded perspective view of the movable wedge device according to the first embodiment disclosed here.

Next, the movable wedge device 60 will be further explained. As shown in FIGS. 2 and 3, the door lock striker 61 includes a base plate 62 and a shaft 63. The base plate 62 is formed in a substantially flat plate shape extending along the end surface B1 of the vehicle body panel B. The shaft 63 is provided at the base plate 62 so as to protrude toward the front side of the vehicle. The shaft 63 is formed in a substantially U-shape having a closed bottom end being located away from the base plate 62 (the closed bottom end of the U-shape corresponds to an upper end portion of the shaft 63). Meanwhile, the movable wedge 65 is configured by a strength member 66 made of, for example, a metal material, and a pair of contact members 67 each formed, for example, by a resin panel. The strength member 66 has rigidity higher than rigidity of the contact member 67.

The movable wedge device 60 includes the door lock striker 61, the movable wedge 65, a spring 76, and a cover 81 fixedly attached to the base plate 62. The spring 76 is arranged between the door lock striker 61 and the movable wedge 65. For convenience, a position located away from the cover 81 in a direction in which the upper end portion of the shaft 63 (the door lock striker 61) extends will be hereinafter referred to as a front side of the movable wedge device 60 (the direction corresponds to a diagonally downward left direction in FIGS. 2 and 3). The front side of the movable wedge device 60 (the movable wedge 65) corresponds to an exterior side of the vehicle in the vehicle width direction. In addition, a position located in the vicinity of the cover 81 in the direction in which the upper end portion of the shaft 63 extends will be hereinafter referred to as a rear side of the movable wedge device 60 (the direction corresponds to a diagonally upward right direction in FIGS. 2 and 3). The rear side of the movable wedge device 60 (the movable wedge 65) corresponds to an interior side of the vehicle in the vehicle width direction.

Figure 7A:
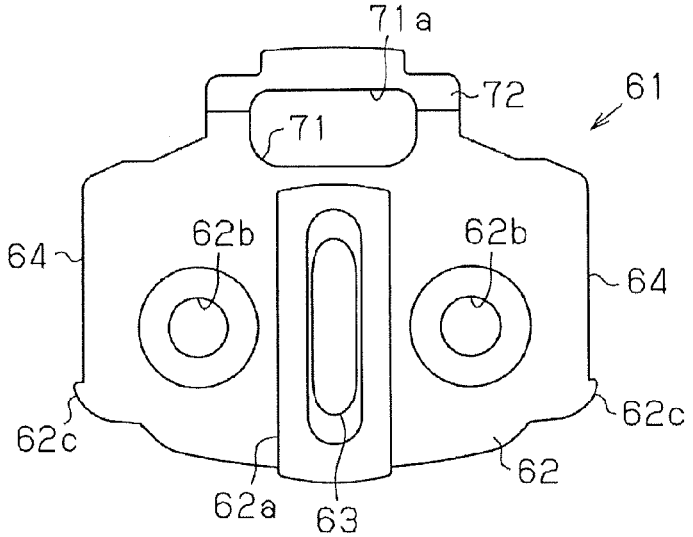
FIG. 7A is a top plan view of a door lock striker provided at the movable wedge device according to the first embodiment disclosed here.
Figure 7B:
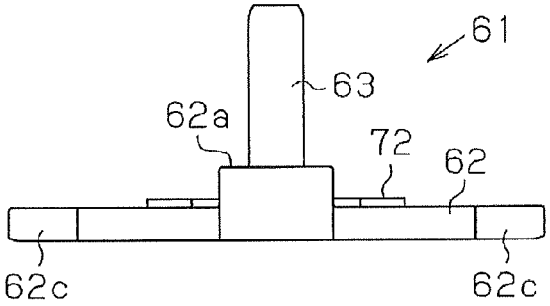
FIG. 7B is a front view of the door lock striker provided at the movable wedge device according to the first embodiment disclosed here.
Figure 7D:
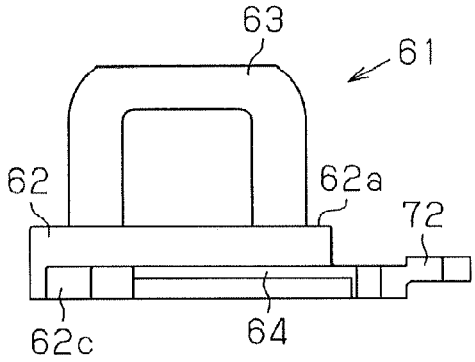
FIG. 7D is a side view of the door lock striker provided at the movable wedge device according to the first embodiment disclosed here.
Figure 7C:
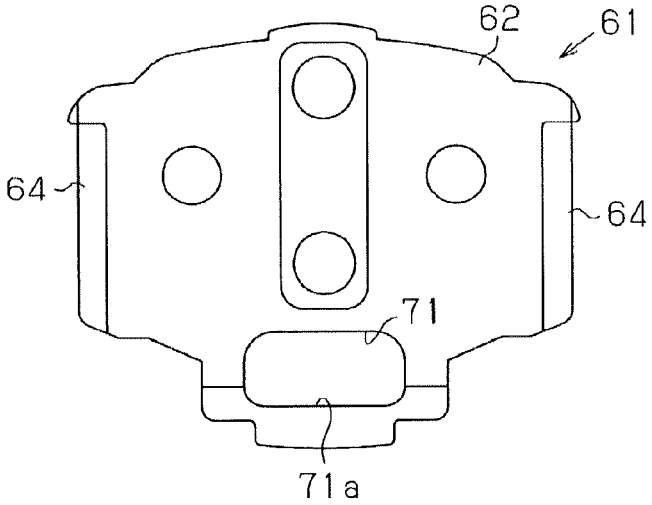
FIG. 7C is a bottom plan view of the door lock striker provided at the movable wedge device according to the first embodiment disclosed here.

As illustrated in FIGS. 7A, 7B, and 7D, a guide protruding portion 62*a* is formed at the base plate 62 of the door lock striker 61 so as to have a substantially rectangular column shape protruding in a protruding direction of the shaft 63. The guide protruding portion 62*a* extends substantially between front and rear end portions of the shaft 63 in a front/rear direction of the door lock striker 61 (the movable wedge device 60) so as to bridge the front and rear end portions of the shaft 63. The front and rear portions of the shaft 63 are fixed via the guide protruding portion 62*a* to the base plate 62 by caulking. Bolt holes 62*b* to which bolts for fixing the base plate 62 to the vehicle body panel B are inserted are formed in the base plate 62 in a manner that the guide protruding portion 62*a* (the shaft 63) is positioned between the bolt holes 62*b* in a lateral direction of the movable wedge device 60. Guide rails 64 each having a substantially rectangular cross-section are formed at both side sides of the base plate 62 in the lateral direction of the movable wedge device 60 so as to linearly extend in the front/rear direction of the door lock striker 61 (the movable wedge device 60). Further, a pair of locking tabs 62*c* each formed in a tab is provided at respective front end portions of the guide rails 64 so as to protrude in a direction in which the locking tabs 62*c* separate from each other in the lateral direction of the movable wedge device 60.

The base plate 62 is further provided with a supporting portion 71*a* positioned at a rear side of the shaft 63 in the front/rear direction of the door lock striker 61 for supporting a part of the spring 76. In other words, a spring accommodating portion 71 providing an accommodation space for the spring 76 is formed in a rear portion the base plate 62. The spring accommodating portion 71 has a substantially rectangular shape. The spring accommodating portion 71 is configured by a hole formed in the rear portion of the base plate 62 and a rear wall of the spring accommodating portion 71 serves as the supporting portion 71*a*. A stepped portion 72 is formed at a rear end of the base plate 62 so as to be raised upward from an upper surface of the base plate 62 in the protruding direction of the shaft 63. The upper surface of the base plate 62 faces the protruding direction of the shaft 63.

As illustrated in FIG. 3, the spring 76 includes a pair of coil portions 76*a* and arm portions 76*b* protruding from the respective coil portions 76*a*. The coil portions 76*a* wound in coiled shapes are provided in a manner that the shaft 63 is sandwiched between the coil portions 76*a* in the lateral direction of the movable wedge device 60. The spring 76 is formed in a bilaterally symmetrical shape relative to the shaft 63. The coil portions 76*a* are wound in reverse directions to each other and are connected to each other in an opposite direction from the protruding direction of the shaft 63. The arm portions 76*b* connecting to the respective coil portions 76*a* protrude in diagonally forward directions in such a way that end portions of the arm portions 76*b* gradually separate from each other in the lateral direction of the movable wedge device 60.

Figure 4:
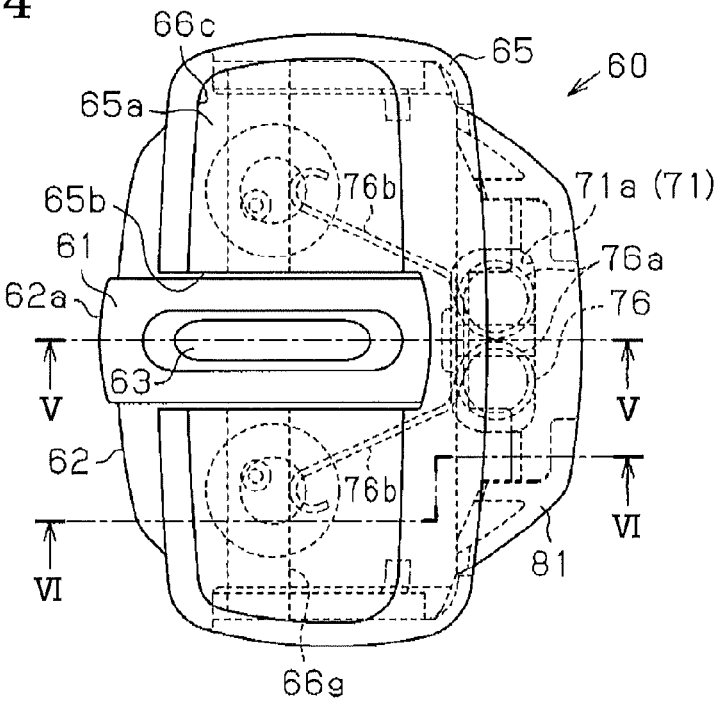
FIG. 4 is a plan view of the movable wedge device according to the first embodiment disclosed here.

As illustrated in FIG. 4, the coil portions 76*a* are accommodated in the spring accommodating portion 71 and are supported by the supporting portion 71*a* at an opposite side from a direction in which the arm portions 76*b* protrude. In other words, the supporting portion 71*a* serves as a supporting surface being in contact with respective outer circumferential surfaces of the coil portions 76*a*. The arm portions 76*b* are laid on the base plate 62 so that the shaft 63 is arranged between the arm portions 76*b* in the lateral direction of the movable wedge device 60.

Figure 5:
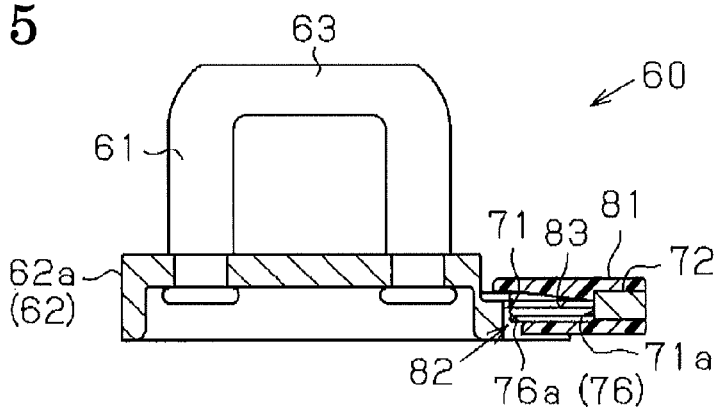
FIG. 5 is a cross-sectional view taken along the line V-V of FIG. 4.
Figure 8A:
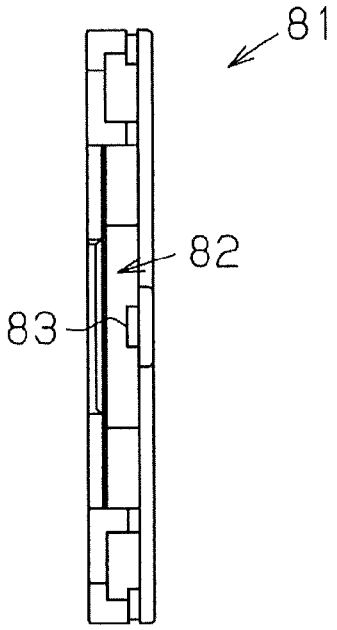
FIG. 8A is a front view of a cover to be attached to the door lock striker of the first embodiment disclosed here.
Figure 8B:
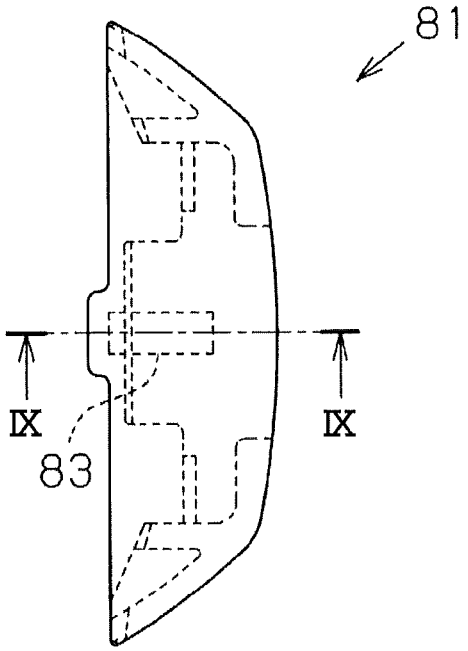
FIG. 8B is a top plan view of the cover to be attached to the door lock striker of the first embodiment disclosed here.
Figure 9:
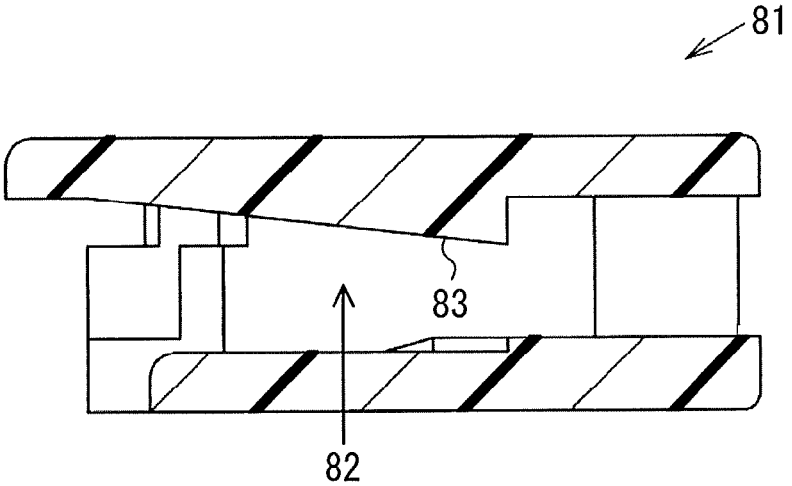
FIG. 9 is a cross-sectional view taken along the line IX-IX of FIG. 8.

As illustrated in FIGS. 5, 8A, and 8B, the cover 81 includes an accommodation space 82 for accommodating therein the spring 76 in cooperation with the base plate 62 (the spring accommodating portion 71). As illustrated in FIG. 9, the accommodation space 82 is formed so as to extend between front and rear ends of the cover 81.

Figure 6:
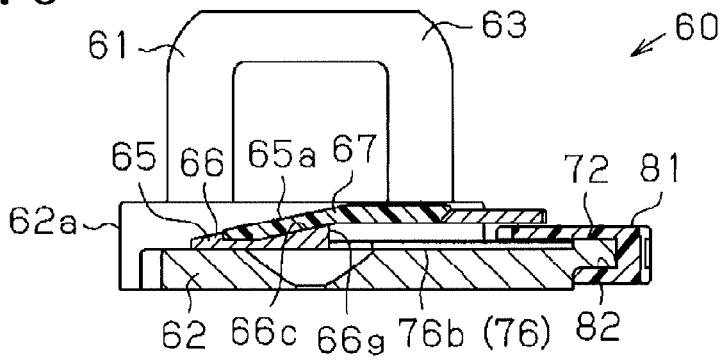
FIG. 6 is a cross-sectional view taken along the line VI-VI of FIG. 4.

Further, a tab 83 is formed at a front portion of the cover 81 so as to be positioned between the coil portions 76*a*. A rear end portion of the base plate 62 is fitted to the accommodation space 82 as illustrated in FIG. 6, and the tab 83 is engaged with the stepped portion 72 of the base plate 62 as shown in FIG. 5; thereby, the cover 81 is fixed to the base plate 62. Each of the coil portions 76*a* of the spring 76 includes upper and lower ends facing the protruding direction of the shaft 63 and the opposite direction of the protruding direction of the shaft 63, respectively (see FIG. 3). The upper and lower ends of the coil portion 76*a* are supported by opposite facing inner walls of the accommodation space 82. A rear end of the coil portion 76*a* is supported by the rear wall of the spring accommodating portion 71.

The movable wedge 65 is provided at the base plate 62 so as to cover the upper surface of the base plate 62, which upper surface faces the protruding direction of the shaft 63. As illustrated in FIG. 3, the strength member 66 of the movable wedge 65 is formed in a substantially rectangular frame. A guide groove 66*a* is formed in a substantially central portion of a front end portion of the strength member 66 so as to extend in the front/rear direction of the movable wedge device 60. Guide grooves 66*b* are formed at both side ends of the strength member 66 in the lateral direction of the movable wedge device 60 so as to extend in the front/rear direction of the movable wedge device 60. The guide grooves 66*b* include openings formed continuously along the front/rear direction of the movable wedge device 60. The openings of the guide grooves 66*b* have U-shaped cross sections facing each other in the lateral direction of the door lock striker 61. The guide groove 66*a* slidably engages with the guide protruding portion 62*a* of the base plate 62 and the guide grooves 66*b* slidably engage with the guide rails 64 of the base plate 62; thereby, the strength member 66 is configured to be movable relative to the base plate 62 within a certain range in the front/rear direction of the movable wedge device 60. In other words, the strength member 66 (the movable wedge 65) is slidable relative to the base plate 62 in the front/rear direction of the movable wedge device 60, for example, via a pair of rail mechanisms (each of the rail mechanisms is formed by the guide rail 64 and the guide groove 66*b*).

Figure 11A:
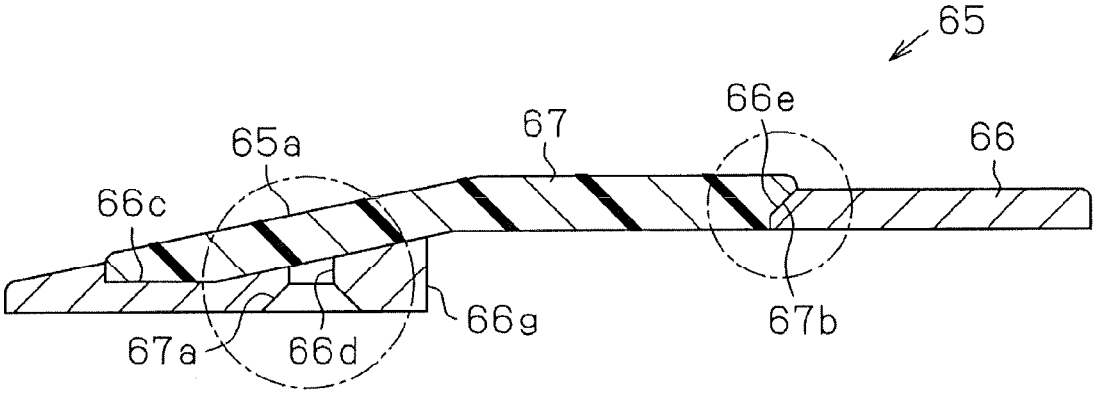
FIG. 11A is a cross-sectional view take along the line XIA-XIA of FIG. 10A.
Figure 11B:
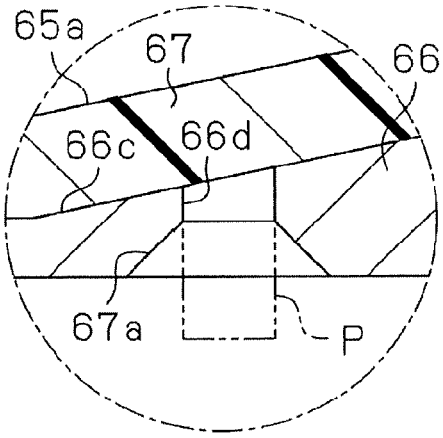
FIG. 11B is an enlarged view of a portion of FIG. 11A.
Figure 11C:
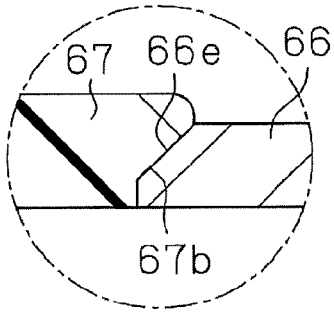
FIG. 11C is an enlarged view of a portion of FIG. 11A.
Figure 12:
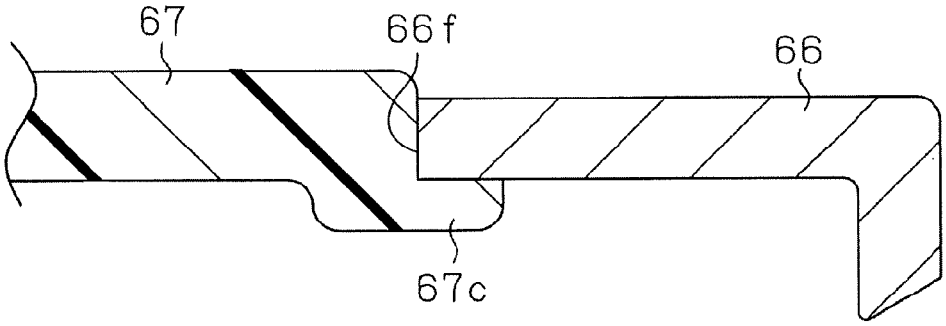
FIG. 12 is a cross-sectional view taken along the line XII-XII of FIG. 10A.

As illustrated in FIG. 3, an attachment recessed portion 66*c* is formed at a rear side of the front end portion of the strength member 66. The attachment recessed portion 66*c* is recessed toward the base plate 62 along a lateral direction of the strength member 66 over a substantially entire length thereof. A pair of attachment holes 66*d* are formed in the attachment recessed portion 66*c* in the lateral direction of the strength member 66 in such a manner that the guide groove 66*a* is provided between the attachment holes 66*d*. Each of the attachment holes 66*d* penetrates the strength member 66 in a thickness direction thereof (in the protruding direction of the shaft 63). As illustrated in FIGS. 11A and 11C, chamfered portions 66*e* each having an inclined surface are formed at a front edge of a rear end portion of the strength member 66 so as to be positioned at an intermediate portion of the rear end portion in an extending direction thereof along the lateral direction of the strength member 66. Thus, the rear end portion of the strength member 66 is configured to be sharpened diagonally toward a front side of the base plate 62 by the chamfered portions 66*e*. As illustrated in FIG. 12, the chamfered portions 66*e* are not formed at side ends of the rear end portion of the strength member 66 in the extending direction and the side ends of the rear end portion form locking portions 66*f* each standing at a substantially right angle to the base plate 62.

As illustrated in FIG. 3, the pair of contact members 67 of the movable wedge 65 is fixed to the strength member 66 so as to be laid on the attachment recessed portion 66*c* in a state where the guide groove 66*a* is provided between the contact members 67. In other words, an attachment protruding portion 67*a* is formed at a front end portion of each of the contact members 67 as shown in FIGS. 11A and 11B. An end portion of the attachment protruding portion 67*a* having a flanged shape is inserted in the attachment hole 66*d* so as to penetrate therethrough. The attachment protruding portion 67*a* is locked by an inner circumferential portion of the attachment hole 66*d*. As illustrated in FIG. 11B, a substantially cylindrical pin P that may penetrate through the attachment hole 66*d* is welded into the flanged shape, thereby forming the attachment protruding portion 67*a*.

As shown in FIG. 11C, chamfered portions 67*b* each having inclined surfaces are formed at respective rear end portions of the contact members 67. The chamfered portions 67*b* are positioned at respective intermediate portions of the contact members 67 in an extending direction thereof so as to face the chamfered portions 66*e* of the strength member 66. Thus, the rear end portion of the contact member 67 is configured to be sharpened diagonally toward a rear side of the base plate 62 by the chamfered portions 66*e*. In addition, as illustrated in FIG. 12, a locking tab 67*c* is formed at an edge of the rear end portion of the contact member 67, which edge faces the locking portion 66*f* of the strength member 66. The locking tab 67*c* is formed so as to protrude rearward in a contact manner with an end surface of the locking portion 66*f*, which end surface faces the base plate 62. Accordingly, the chamfered portion 67*b* and the locking tab 67*c* of the contact member 67 are in contact with the chamfered portion 66*e* of the strength member 66 and the end surface of the locking portion 66*f* of the strength member 66, respectively. Consequently, a front edge of the rear end portion of the strength member 66 is sandwiched between the chamfered portion 67*b* and the locking tab 67*c* in a thickness direction of the strength member 66; thereby, the rear end portion of the strength member 66 is restricted from loosening from the contact member 67 in the thickness direction of the strength member 66.

In order to mount the contact members 67 to the strength member 66, each of the contact members 67 is moved rearward relative to the strength member 66; thereby, the front edge of the rear end portion of the strength member 66 is pressed by the chamfered portion 67*b* and the locking tab 67*c* so as to be sandwiched between the chamfered portion 67*b* and the locking tab 67*c* in the thickness direction of the strength member 66. In such state, the contact member 67 is pivoted about a pivot point, for example, the chamfered portion 67*b*, toward the strength member 66 in the thickness direction thereof while the pin P is inserted in the attachment recessed portion 66*c* to be laid thereon. Then, the end portion of the pin P is inserted through the attachment hole 66*d* and is welded so as to have the flanged shape; thereby, the attachment protruding portion 67*a* is formed. Thus, the contact members 67 are fixedly attached to the strength member 66 and are restricted from loosening from the strength member 66.

Figure 10A:
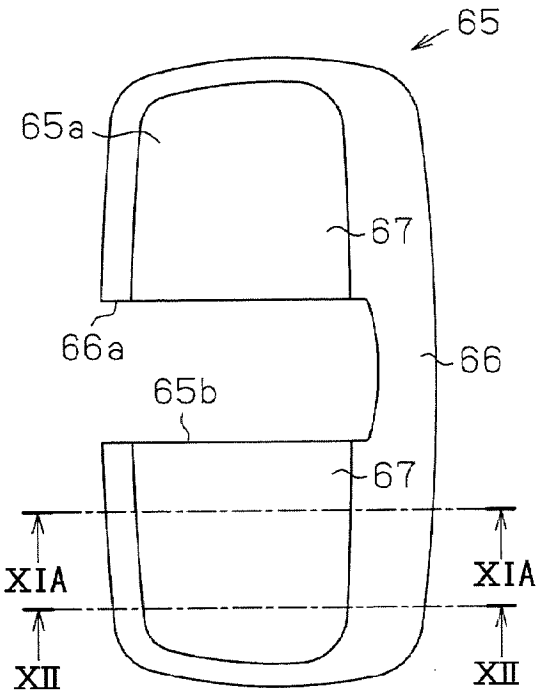
FIG. 10A is a top plan view of a movable wedge to be provided at the movable wedge device according to the first embodiment disclosed here.
Figure 10B:
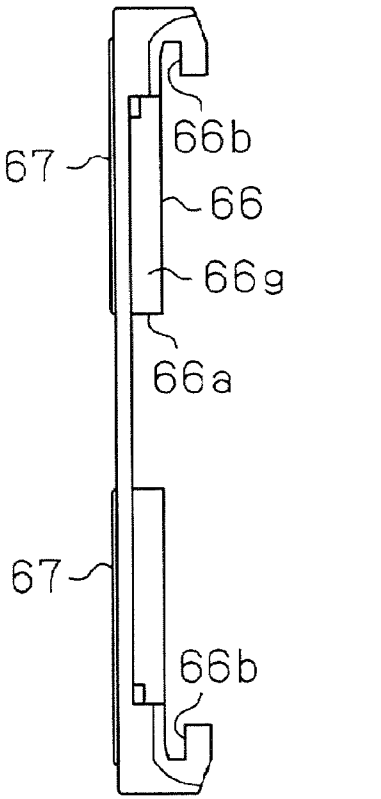
FIG. 10B is a front view of the movable wedge to be provided at the movable wedge device according to the first embodiment disclosed here.
Figure 10C:
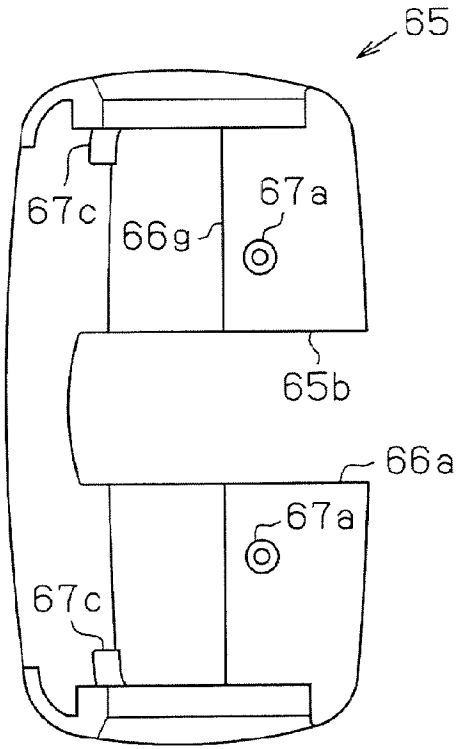
FIG. 10C is a bottom plan view of the movable wedge to be provided at the movable wedge device according to the first embodiment disclosed here.
Figure 10D:
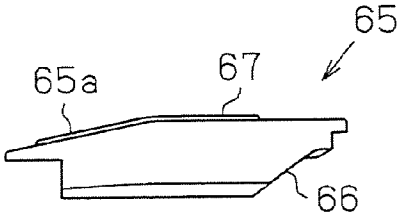
FIG. 10D is a side view of the movable wedge to be provided at the movable wedge device according to the first embodiment disclosed here.

As illustrated in FIGS. 10A, 10D, and 11A, the movable wedge 65 includes an inclined surface 65*a*. The inclined surface 65*a* is formed to be located at the respective front end portions of the contact members 67 fixed to the strength member 66. In addition, as being inclined toward the front side of the movable wedge 65, the inclined surface 65*a* becomes close to the strength member 66 in the thickness direction thereof. As illustrated in FIGS. 10A and 10C, the movable wedge 65 also includes a slit 65*b* cut from the front side of the movable wedge 65. The slit 65*b* is positioned between the pair of contact members 67 that is fixed to the strength member 66 in a state where the guide groove 66*a* at the attachment recessed portion 66*c* is positioned between the contact members 67. In other words, the entire movable wedge 65 slidably engages via the slit 65*b* with the guide protruding portion 62*a* of the base plate 62 (of the door lock striker 61).

In order to assemble the movable wedge device 60, as shown in FIG. 3, the guide groove 66*a* of the strength member 66 (the movable wedge 65) slides relative to the guide protruding portion 62*a* of the base plate 62 from the rear side to the front side of the base plate 62 while the guide grooves 66*b* are being slid along the guide rails 64 formed at the side edges of the base plate 62 in the lateral direction thereof. In such state, the arm portions 76*b* each protruding diagonally toward the front side of the movable wedge device 60 are pressed against a rear end surface 66*g* of the front end portion of the strength member 66 as shown in FIGS. 4 and 6, and the coil portions 76*a* are accommodated in the spring accommodating portion 71 as shown in FIGS. 4 and 5. At this time, the arm portions 76*b* of the spring 76 are pushed by the rear end surface 66*g* and thus an angle between the arm portions 76*b* increases, that is, a distance between the arm portions 76*b* increases. Therefore, torsional forces are generated at the coil portions 76*a*; thereby, the spring 76 generates a biasing force in a direction in which the angle between the arm portions 76*b* decreases. Accordingly, the strength member 66 (the movable wedge 65) is biased toward a front side thereof by the spring 76. Consequently, the strength member 66 is consistently biased relative to the base plate 62 toward the front side of the movable wedge device 60 so that the front edge of the rear end portion of the strength member 66 is brought into contact with a rear end surface of the guide protruding portion 62*a* of the base plate 62 or so that respective front end surfaces of the guide grooves 66*b* are brought into contact with the locking tabs 62*c* of the base plate 62.

Next, the rear end portion of the base plate 62 is fitted to the accommodation space 82 of the cover 81 and the tab 83 is engaged with the stepped portion 72 of the base plate 62; thereby, the cover 81 is fixed to the base plate 62. At this time, the upper end of each of the coil portions 76*a*, which upper end faces the protruding direction of the shaft 63, and the lower end of each of the coil portions 76*a*, which lower end faces the opposite direction of the protruding direction of the shaft 63, are supported by the opposite facing inner walls of the accommodation space 82. In addition, the rear end of each of the coil portions 76*a* is supported by the rear wall of the spring accommodating portion 71.

Figure 13:
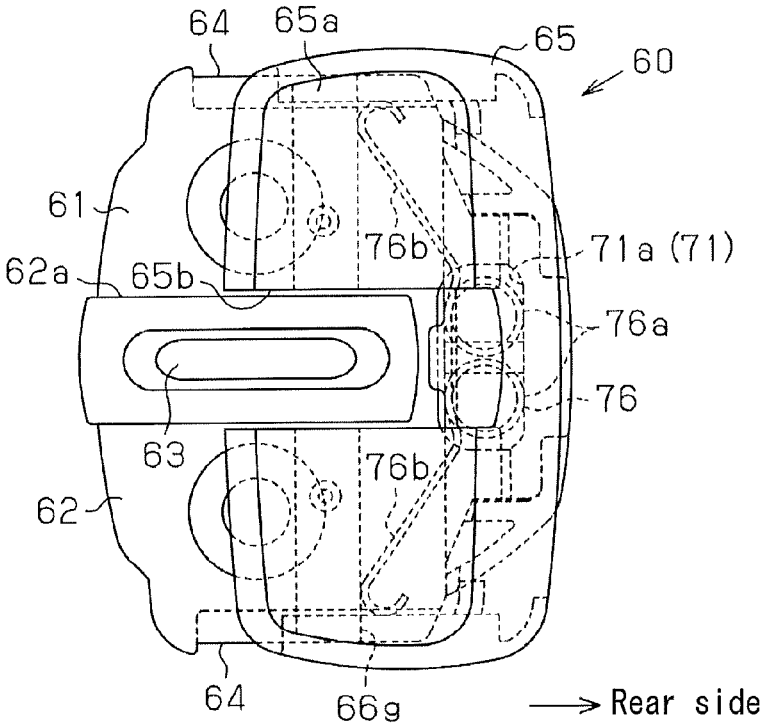
FIG. 13 is a plan view illustrating a movement of the movable wedge device according to the first embodiment disclosed here.
Figure 14:
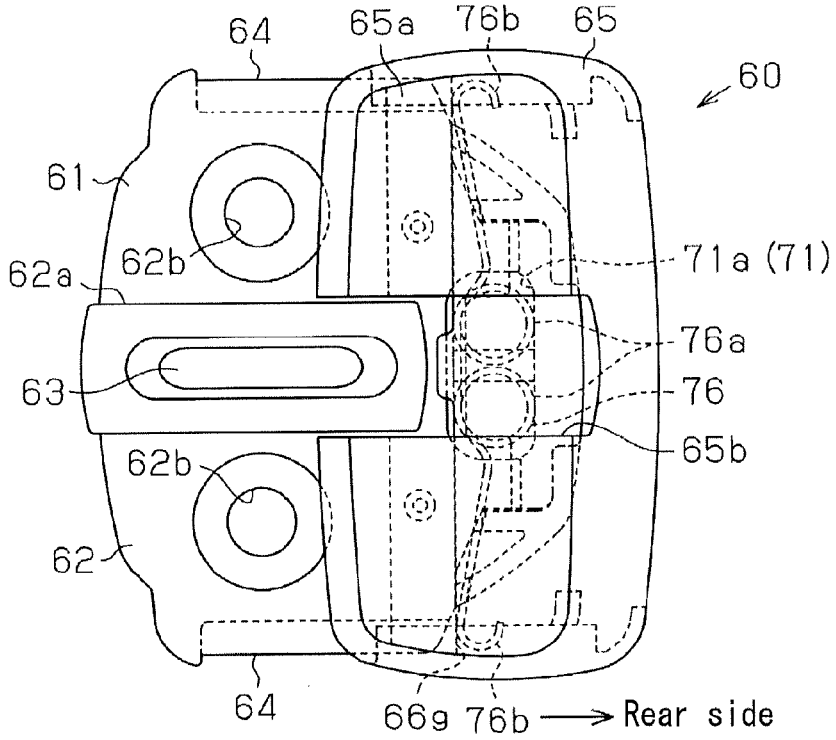
FIG. 14 is a plan view of the movable wedge device according to the first embodiment before the movable wedge device is assembled on a vehicle body panel.

As described above, the assembling of the movable wedge device 60 is completed. In addition, the movable wedge 65 being consistently biased by the spring 76 toward the front side of the movable wedge 65 relative to the base plate 62 is movable in the rear side of the movable wedge 65 against the biasing force of the spring 76 as shown in FIG. 13. In FIG. 13, the arm portions 76*b* are pressed against the rear end surface 66*g* of the strength member 66 and the angle between the arm portions 76*b* increases; therefore, the biasing force in the direction in which the angle between the arm portions 76*b* decreases, that is, the biasing force biasing the strength member 66 (the movable wedge 65) toward the front side of the movable wedge 65 is generated. In particular, as shown in FIG. 14, as the movable wedge 65 moves further toward the rear side thereof against the biasing force of the spring 76, the bolt holes 62*b* may be exposed in a direction in which the bolts are inserted in the bolt holes 62*b*, respectively.

Figure 15:
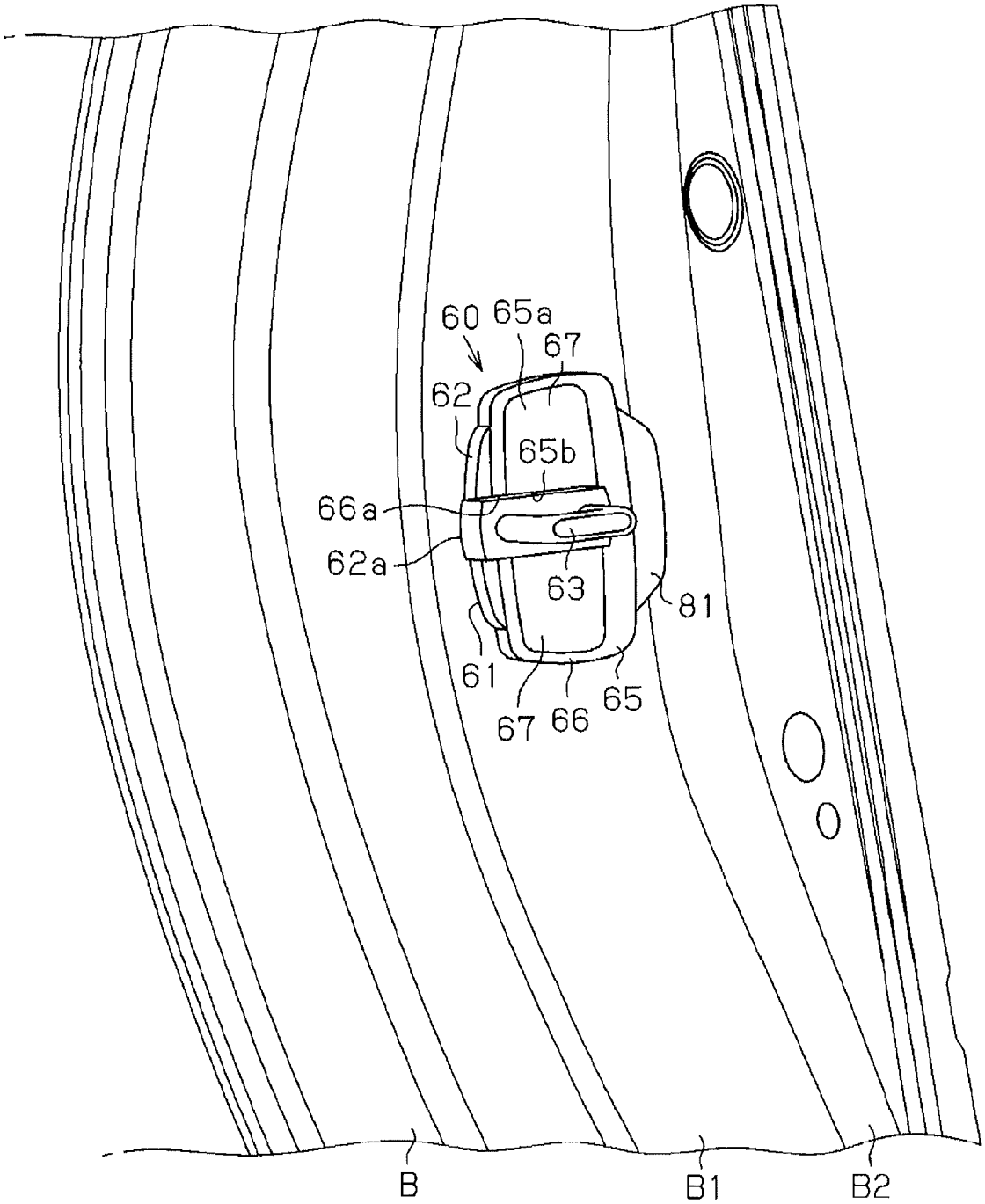
FIG. 15 is a perspective view illustrating a state where the movable wedge device according to the first embodiment is arranged at the vehicle body panel.

As shown in FIGS. 1 and 15, the movable wedge device 60 having the above-explained configuration is fixedly attached to the end surface B1 of the vehicle body panel B. In a state where the movable wedge device 60 is attached to the end surface B1, a direction in which the upper end portion of the shaft 63 (the door lock striker 61) extends, that is, the front/rear direction of the movable wedge device 60 and a moving direction of the movable wedge 65, coincides with the vehicle width direction. In other words, the moving direction of the movable wedge 65 coincides with a direction in which the door panel D is moved close to and away from the vehicle body panel B in accordance with opening and closing operations of the vehicle door. Consequently, the movable wedge 65 (the strength member 66) surrounds the shaft 63 of the door lock striker 61 so that the guide groove 66*a* is opened to the fixed wedge 68 in the direction in which the door panel D is moved close to and away from the vehicle body panel B. The inclined surface 65*a* is inclined so as to become close to the end surface B1 toward the exterior side in the vehicle width direction.

In order to attach the movable wedge device 60 to the end surface B1 of the vehicle body panel B, the movable wedge 65 is moved toward the rear side thereof (in the interior side in the vehicle width direction) as explained above against the biasing force of the spring 76 so that the bolt holes 62*b* are exposed. In a state where the bolt holes 62*b* are exposed, the bolts for fixing the base plate 62 to the vehicle body panel B are inserted in the bolt holes 62*b* and are tightened to the vehicle body panel B. After the movable wedge device 60 is attached to the end surface B1 and the movable wedge 65 is released, the movable wedge 65 is biased by the spring 76 toward the front side of the movable wedge 65 so that the front edge of the rear end portion of the strength member 66 is brought into contact with the rear end surface of the guide protruding portion 62*a* of the base plate 62 or so that the front end surfaces of the guide grooves 66*b* are brought into contact with the locking tabs 62*c* of the base plate 62. Accordingly, the bolt holes 62*b* (and the bolts inserted therein) are covered by the movable wedge 65 so as not to be exposed to the outside. Thus, the movable wedge device 60 is configured so that the bolt holes 62*b* are covered by the movable wedge 65 so as not to be exposed to the outside in a normal state, that is, in the state where the movable wedge 65 is not slid toward the rear side thereof against the biasing force of the spring 76.

Figure 16:
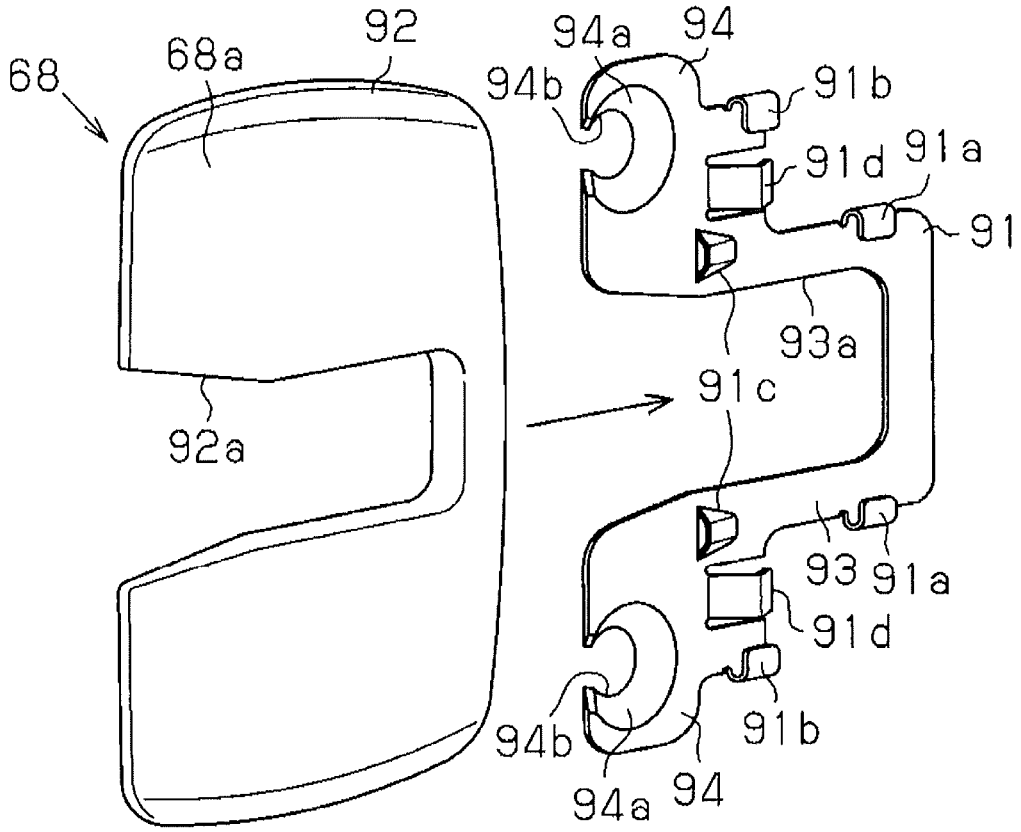
FIG. 16 is an exploded perspective view of a fixed wedge to be provided at the vehicle door fixing apparatus according to the first embodiment disclosed here.

Next, the fixed wedge 68 will be described in more detail. As illustrated in FIG. 16, the fixed wedge 68 includes an attachment member 91 made of, for example, a metal plate, and a wedge member 92 made of, for example, a resin material. The attachment member 91 integrally includes a body portion 93 and a pair of extending portions 94. The body portion 93 includes a groove portion 93*a* formed into a substantially rectangular shape, therefore being formed in a substantially U-shape. The pair of extending portions 94 is formed to extend from an opening of the groove portion 93*a* toward opposite directions from each other in a lateral direction of the wedge member 92 in a manner that the groove portion 93*a* is positioned between the extending portions 94. The attachment member 91 is symmetrically formed relative to the groove portion 93*a*. In addition, a direction to which the substantially U-shape of the body portion 93 (the attachment member 91) is opened corresponds to a front side of the fixed wedge 68 (the aforementioned direction is a diagonally downward left direction in FIG. 16). The opposite direction of the front side of the fixed wedge 68 corresponds to a rear side of the fixed wedge 68 (the opposite direction of the front side is a diagonally upward right direction in FIG. 16).

The attachment member 91 includes a pair of fixed-wedge guide rails 91*a* for engaging with the wedge member 92 and a pair of fixed-wedge guide rails 91*b* for engaging with the wedge member 92 (the fixed-wedge guide rails 91*a* and 91*b* will be hereinafter simply referred to as guide rails 91*a* and 91*b*). The pair of guide rails 91*a* is formed at side ends of a rear end portion of the body portion 93 in a lateral direction thereof so as to stand vertically from the body portion 93 and so as to be bent in an extending manner toward each other in the lateral direction, thereby having substantially L-shapes. The pair of guide rails 91*b* is formed at side ends of respective rear end portions of the extending portions 94 so as to stand vertically from the body portion 93 and so as to be bent in an extending manner toward each other in the lateral direction of the body portion 93, thereby having substantially L-shapes. The pair of guide rails 91*b* may be bent in a direction to be away from each other in the lateral direction of the body portion 93. The attachment member 91 further includes a pair of first locking portions 91*c* formed at a front side of the pair of guide rails 91*a*. The first locking portions 91*c* stand vertically from the body portion 93 and have substantially semi-dome shapes. The first locking portions 91*c* protrude in a direction in which the guide rails 91*a* and the like protrude. A protruding length of each of the first locking portions 91*c* gradually increases from a rear side to a front side thereof. Moreover, a pair of engagement convex portions 91*d* is formed at the attachment member 91. Each of the engagement convex portions 91*d* is formed by cutting and raising a rear end portion of each of the extending portions 94 so that the cut portion is folded at a fold line, i.e. a front end of the cut portion, diagonally in the direction in which the first locking portion 91*c* is raised. A rear end portion of the engagement convex portion 91*d* is bent toward the body portion 93; thereby, the engagement convex portion 91*d* has a convex portion.

In addition, recessed portions 94*a* each having a substantially conical shape are formed in the extending portions 94, respectively. Each of the recessed portions 94*a* serves as a bearing surface for a bolt 96 (see FIG. 21) for fixing the attachment member 91 (the fixed wedge 68) to the door panel D. A bolt hole 94*b* into which the bolt 96 is inserted is formed at a substantially center of the recessed portion 94*a*. The bolt hole 94*b* has a substantially major arc shape opened to the front side of the fixed wedge 68 in order to reduce a size of the attachment member 91 (the pair of extending portions 94) in the front/rear direction of the fixed wedge 68. The bolt hole 94*b* may be completely circular in case where it is not necessary for the size of the attachment member 91 (the pair of extending portions 94) to be reduced in the front/rear direction.

Figure 17:
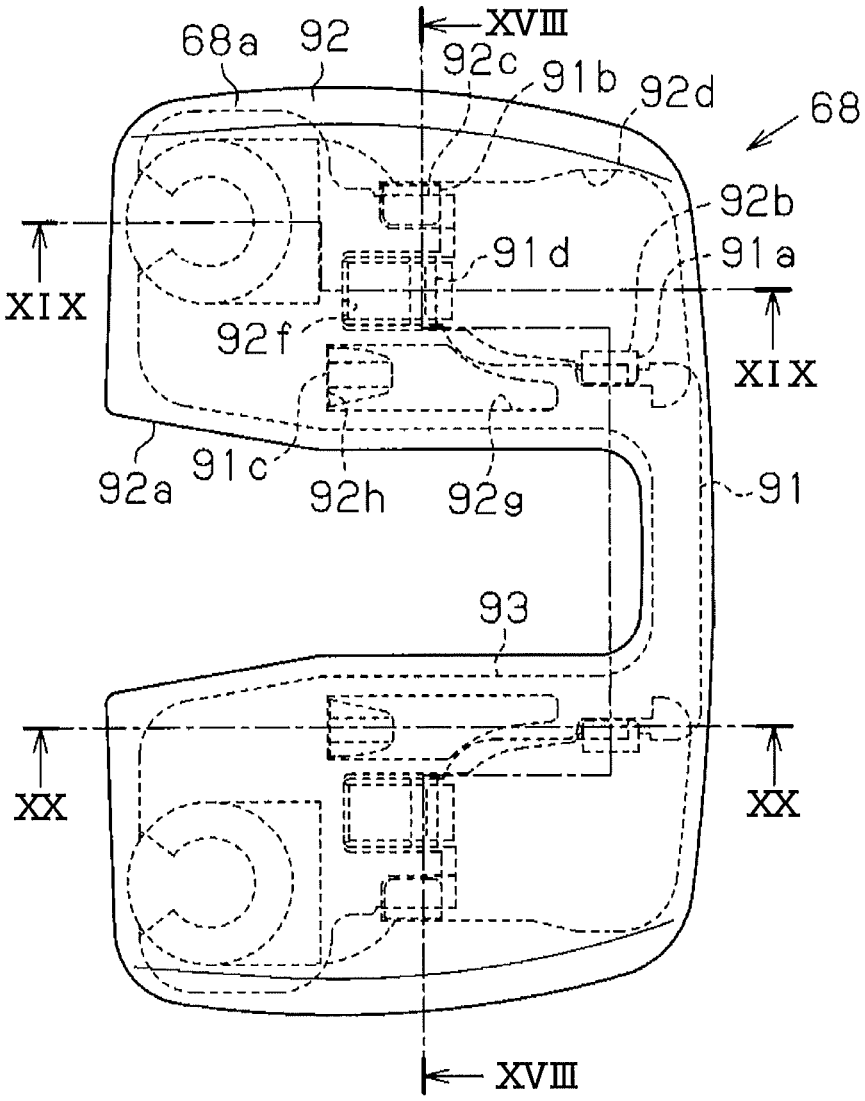
FIG. 17 is a plan view of the fixed wedge according to the first embodiment disclosed here.
Figure 18:
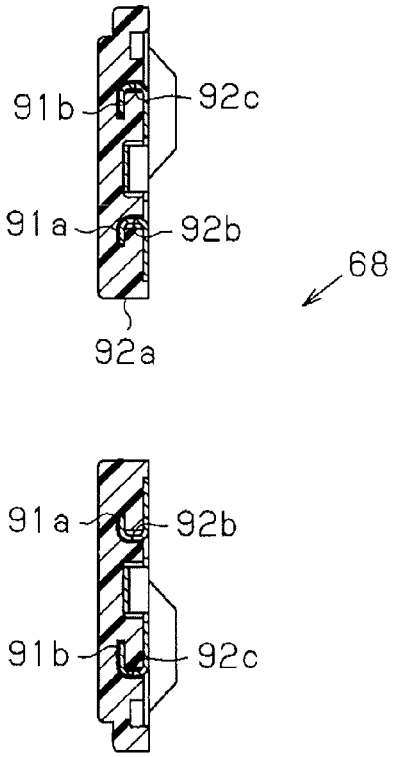
FIG. 18 is a cross-sectional view taken along the line XVIII-XVIII of FIG. 17.

The wedge member 92 includes a slit 92*a* cut from the front side to the rear side of the fixed wedge 68 to be formed in a substantially U-shape. As illustrated in FIG. 17, the wedge member 92 providing a design surface of the fixed wedge 68 is provided attachable and removable relative to the attachment member 91. The wedge member 92 is fixed to the attachment member 91 so as to cover the entire attachment member 91 and so as to face the guide rails 91*b* and the like. In other words, as illustrated in FIG. 18, the wedge member 92 includes a pair of fixed-wedge guide grooves 92*b* for engaging with the attachment member 91 and a pair of fixed-wedge guide grooves 92*c* for engaging with the attachment member 91 (the fixed-wedge guide grooves 92*b* and 92*c* will be hereinafter simply referred to as guide grooves 92*b* and 92*c*. The guide grooves 92*b* each having a substantially L-shaped cross section and the guide grooves 92*c* each having a substantially L-shaped cross section slidably engage with the guide rails 91*a* and the guide rails 91*b*, respectively. The pair of guide grooves 92*b* and the pair of guide grooves 92*c* slidably engage with the pair of guide rails 91*a* and the pair of guide rails 91*b*, thereby allowing the wedge member 92 to move relative to the attachment member 91 within a certain range in the front/rear direction of the fixed wedge 68. Thus, the wedge member 92 may be slidably attached to and removed from the attachment member 91.

Figure 19:
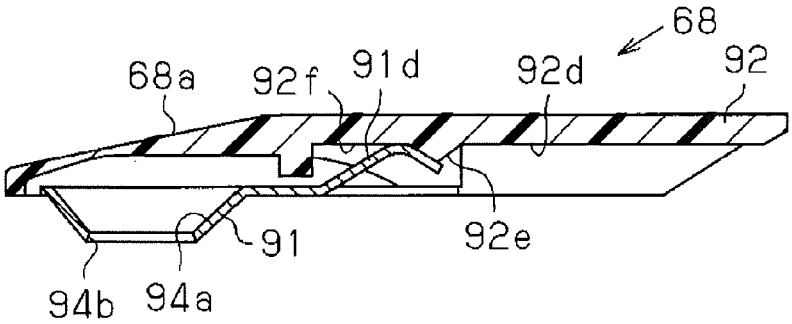
FIG. 19 is a cross-sectional view taken along the line XIX-XIX of FIG. 17.

As illustrated in FIG. 19, in a state where the wedge member 92 is at an attachment position relative to the attachment member 91, recessed portions 92*d* are formed at the wedge member 92. Each of the recessed portions 92*d* is in contact with a portion located at a rear side of the engagement convex portion 91*d* and including the engagement convex portion 91*d*. The recessed portion 92*d* includes a convex portion 92*e* protruding toward the engagement convex portion 91*d* so as to be in pressure contact with a rear end of the engagement convex portion 91*d*. The convex portion 92*e* is formed in a substantially triangular cross section. Further, the wedge member 92 includes engagement recessed portions 92*f* each configured by a front end surface of the recessed portion 92*d*, a front end surface of the convex portion 92*e*, and an inner wall surface positioned between the front end surface of the recessed portion 92*d* and the front end surface of the convex portion 92*e*.

When inserting the engagement convex portion 91*d* to the recessed portion 92*d* from a rear end thereof in accordance with a rearward movement of the wedge member 92 relative to the attachment member 91, the engagement convex portion 91*d* is elastically deformed by the convex portion 92*e* to be fitted to the engagement recessed portion 92*f*. Therefore, the wedge member 92 is restricted from moving in the front/rear direction (that is, the sliding movement of the wedge member 92 along a sliding direction of the guide grooves 92*b* and the guide grooves 92*c* relative to the guide rails 91*a* and the guide rails 91*b* is restricted). In particular, the wedge member 92 is restricted from moving relative to the attachment member 91 in a direction in which the wedge member 92 is removed from the attachment member 91. Additionally, for example, an external force exceeding a certain level is applied to the wedge member 92 attached to the attachment member 91, in the direction in which the wedge member 92 is removed from the attachment member 91. At this time, the engagement convex portion 91*d*, which may be elastically deformed by the convex portion 92*e*, moves beyond the convex portion 92*e*, therefore being detached from the engagement recessed portion 92*f*. As a result, the wedge member 92 attached to the attachment member 91 may be removed therefrom.

Figure 20:
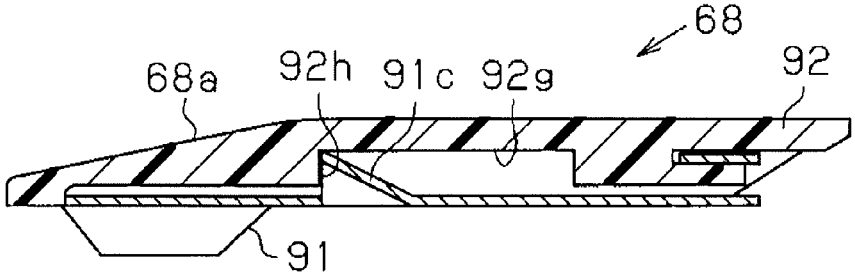
FIG. 20 is a cross-sectional view taken along the line XX-XX of FIG. 17.

As illustrated in FIG. 20, in a state where the wedge member 92 is positioned at the attachment position relative to the attachment member 91, recessed portions 92*g* for accommodating therein the first locking portions 91*c* are formed at the wedge member 92. A front end surface (facing the rear side of the fixed wedge 68) of each of the recessed portions 92*g* forms a second locking portion 92*h* while. In other words, the front end surface of the recessed portion 92*g* is positioned in the vicinity of the front end surface of the first locking portion 91*c* or in contact with the first locking portion 91*c* in the direction in which the wedge member 92 is attached to the attachment member 91 (i.e., an attaching direction of the wedge member 92 relative to the attachment member 91), thereby providing the second locking portion 92*h*. Therefore, when attaching the wedge member 92 to the attachment member 91, the wedge member 92 is shifted to the attachment position relative to the attachment member 91 in accordance with the rearward movement of the wedge member 92 relative to the attachment member 91. At this time, the second locking portion 92*h* is engaged with the first locking portion 91*c*; thereby, the wedge member 92 is restricted from further moving rearward, that is, in the attaching direction relative, to the attachment member 91. As a result, the wedge member 92 is restricted from excessively moving relative to the attachment member 91 beyond the intended attachment position in the attaching direction relative to the attachment member 91.

As illustrated in FIGS. 19 and 20, the fixed wedge 68 includes an inclined surface 68*a* formed at a front end portion of the wedge member 92 fixed to the attachment member 91. The inclined surface 68*a* is inclined so as to become close to the attachment member 91 in a thickness direction thereof, that is, so as to be inclined diagonally toward the front side of the fixed wedge 68.

In order to assemble the fixed wedge 68, the wedge member 92 is moved from a front side to a rear side of the attachment member 91 as illustrated in FIG. 16, and the guide rails 91*a* and the guide rails 91*b* of the attachment member 91 are slid along the guide grooves 92*b* and the guide grooves 92*c* of the wedge member 92, respectively, as illustrated in FIG. 17. Further, the engagement convex portions 91*d* of the attachment member 91 are slid to the recessed portions 92*d* of the wedge member 92 respectively, thereafter being fitted to the engagement recessed portions 92*f*. Furthermore, the first locking portions 91*c* of the attachment member 91 are slid to the recessed portions 92*g* of the wedge member 92, respectively, thereafter being moved close to or being brought into contact with the second locking portions 92*h* in the aforementioned attaching direction. Thus, the assembling of the fixed wedge 68 is completed.

Figure 21:
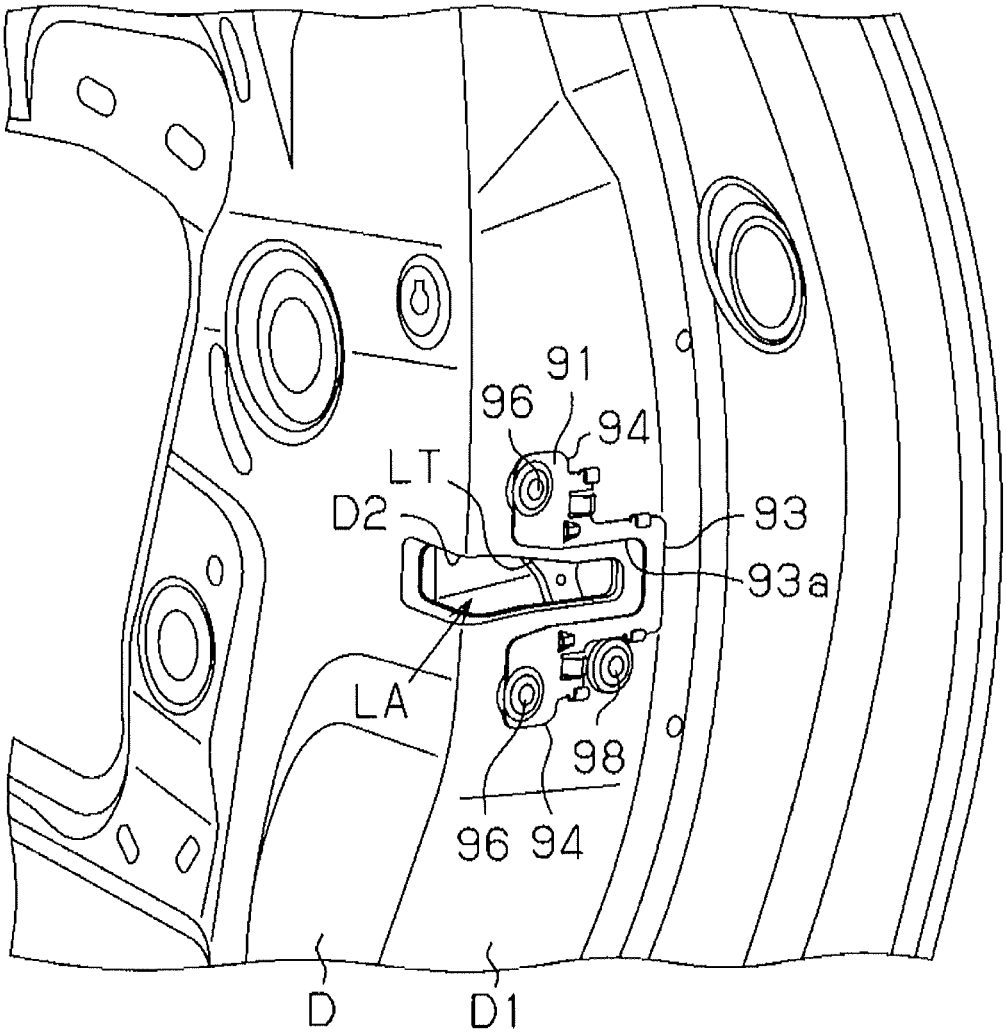
FIG. 21 is a perspective view illustrating a state where an attachment member of the fixed wedge according to the first embodiment disclosed here is attached to a door panel.
Figure 23:
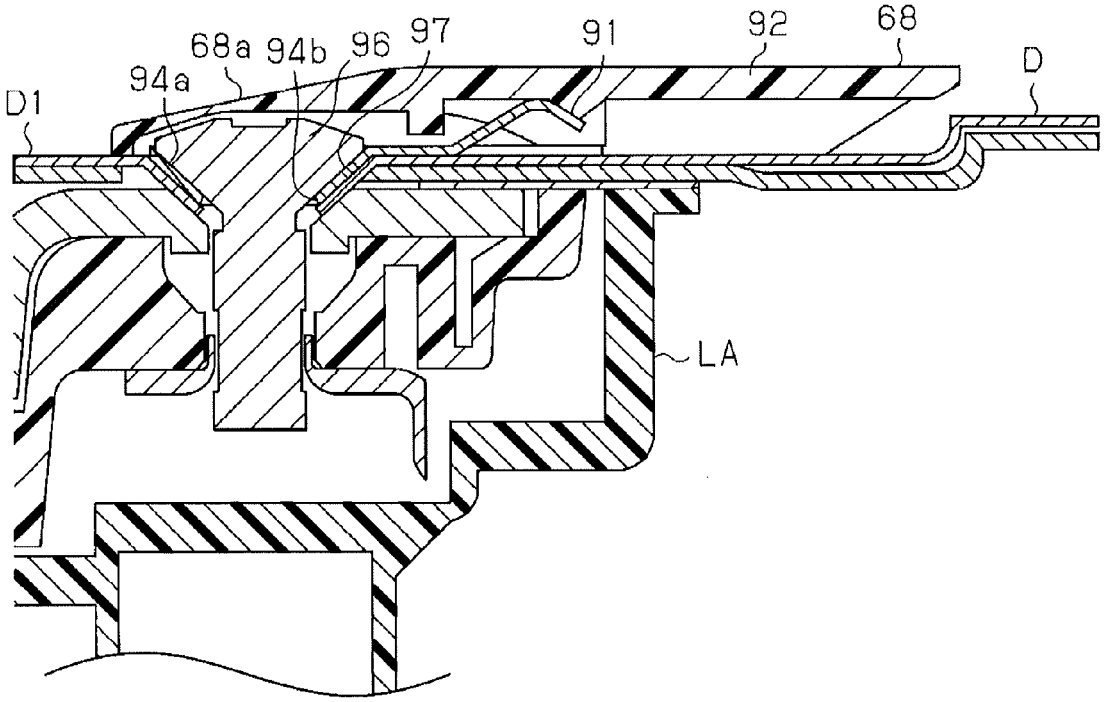
FIG. 23 is a cross-sectional side view illustrating a state where the fixed wedge according to the first embodiment is assembled on the door panel.

In order to mount the fixed wedge 68 to the door panel D (the end surface D1 extending in the vehicle width direction and facing the vehicle body panel B), first, the attachment member 91, without the wedge member 92 attached thereto, is fixedly attached to the end surface D1 as illustrated in FIG. 21. At this time, the attachment member 91 is attached to the door panel D together with the door lock assembly LA, which is temporarily attached to the door panel D so as to be positioned at the opposite side of the attachment member 91 relative to the door panel D. In other words, the door lock assembly LA is tightened to the door panel D in advance so as to be positioned at the opposite side of the attachment member 91 relative to the door panel D, by means of a bolt 98 that is arranged at the door panel D so as not to interfere with the attachment member 91 (the fixed wedge 68). Thereafter, the attachment member 91 is fixedly attached to the end surface D1 together with the door lock assembly LA by means of the bolts 96 each serving as a fixing member. In a state where the attachment member 91 is attached to the end surface D1, the groove portion 93*a* of the attachment member 91 surrounds a portion of a recess D2 formed in the door panel D so as to receive the door lock striker 61 (the portion of the recess D2 extends in the vehicle width direction). In particular, the groove portion 93*a* surrounds the portion of the recess D2 while keeping a certain distance relative to the recess D2. The shaft 63 of the door lock striker 61 is inserted in and removed from the recess D2. In addition, as illustrated in FIG. 23, the recessed portion 94*a* of the attachment member 91 of the fixed wedge 68, which recessed portion 94*a* protrudes toward the end surface D1, is configured to be fitted to a recessed portion 97 formed at the door panel D.

Figure 22:
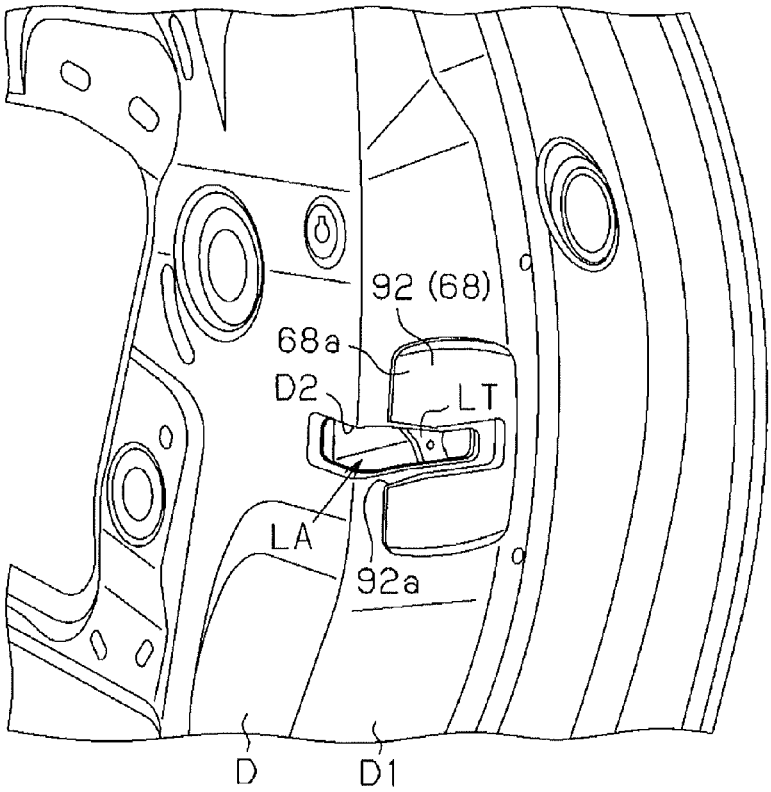
FIG. 22 is a perspective view illustrating a state where the fixed wedge of the first embodiment disclosed here is attached to the door panel.

Next, as shown in FIG. 22, the wedge member 92 is fixedly attached in the aforementioned manner relative to the attachment member 91 secured to the end surface D1. In such condition, the entire attachment member 91 is covered by the wedge member 92, thereby being restricted from being exposed to the outside. In addition, the bolts 96 for fixing the attachment member 91 to the door panel D are also restricted from being exposed to the outside.

According to the fixed wedge 68 having the above-described configuration, as illustrated in FIGS. 1 and 22, in a state where the fixed wedge 68 is attached to the end surface D1, a direction (an extending direction) in which the slit 92*a* extends (i.e., the front/rear direction of the fixed wedge 68) coincides with the direction in which the door panel D is moved close to and away from the vehicle body panel B in accordance with the opening and closing operations of the vehicle door. That is, the extending direction of the slit 92*a* corresponds to the vehicle width direction in a state where the vehicle door is closed. Therefore, the slit 92*a* of the fixed wedge 68 (the wedge member 92) is formed in a shape that matches a shape of the portion of the recess D2, which portion extends in a width direction of the recess D2 (in the vehicle width direction in a state where the vehicle door is closed). In other words, the fixed wedge 68 is configured so that the slit 92*a* surrounds the recess D2 in an open manner toward the movable wedge device 60 in the direction in which the door panel D is moved close to and away from the vehicle body panel B in accordance with the opening and closing operations of the vehicle door. In addition, the inclined surface 68*a* is inclined relative to the body panel B so as to become close to the end surface D1 toward the direction in which the door panel D is moved close to the vehicle body panel B in accordance with the closing operation of the vehicle door (i.e., the inclined surface 68*a* is inclined relative to the body panel B so as to become close to the end surface D1 toward the interior side of the vehicle in the vehicle width direction).

According to the vehicle door fixing apparatus of the first embodiment, as illustrated in FIG. 1, the inclined surface 65*a* of the movable wedge 65 and the inclined surface 68*a* of the fixed wedge 68 (the wedge member 92) are in pressure contact with each other in a state where the vehicle door is closed.

Next, an operation of the vehicle door fixing apparatus of the first embodiment will be described. According to the vehicle door fixing apparatus of the first embodiment, in a state where the vehicle door is closed, the inclined surface 65*a* of the movable wedge 65 that is arranged at the vehicle body panel B so as to slidably reciprocate relative thereto, is in contact with the inclined surface 68*a* of the fixed wedge 68 that is fixedly attached to the door panel D (see FIG. 1). At this time, the movable wedge 65 is pressed against the fixed wedge 68 by the biasing force of the spring 76; therefore, the vehicle door is pushed toward a hinge of the vehicle door. As a result, rattles or vibrations of the vehicle door are restricted.

Figure 24:
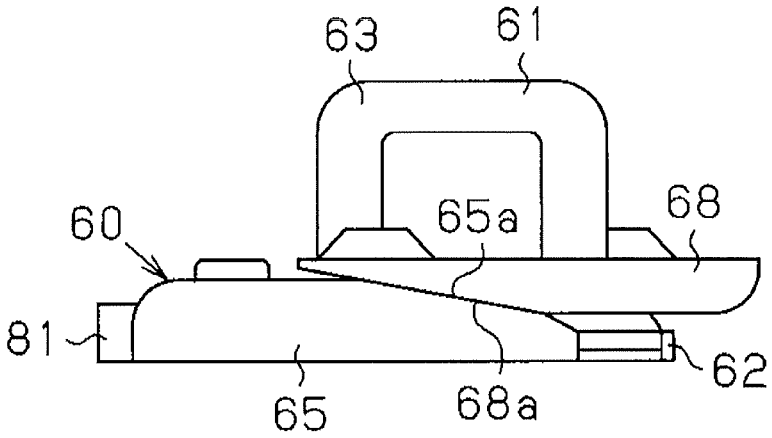
FIG. 24 is a side view illustrating a state of the movable wedge device and the fixed wedge of the vehicle door fixing apparatus according to the first embodiment when a vehicle body is not deformed.
Figure 25:
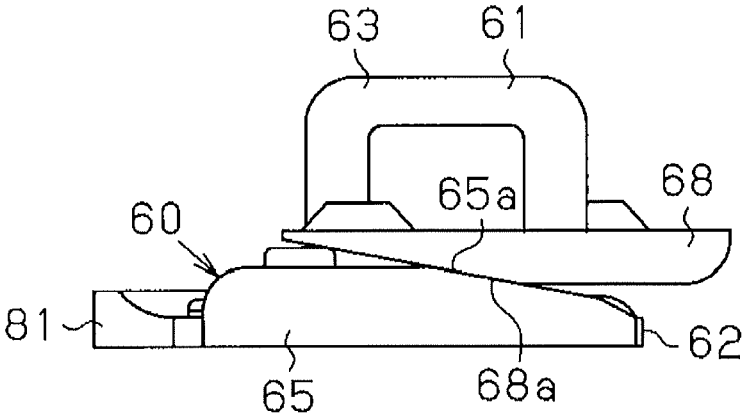
FIG. 25 is a side view illustrating a state of the movable wedge device and the fixed wedge of the vehicle door fixing apparatus according to the first embodiment when the vehicle body is deformed.

In a case where a bending deformation occurs to the vehicle body in the width direction thereof (in a right/left direction thereof), for example, when the vehicle makes a turn, the movable wedge 65 at a side of the vehicle at which the vehicle body expands moves relative to the fixed wedge 68 in the right direction when viewed in FIG. 24. At this time, the movable wedge 65 in a state illustrated in FIG. 24 moves to a state illustrated in FIG. 25. Thus, the fixed wedge 68 moves upward when viewed in FIG. 24 (that is, in the longitudinal direction, i.e. a front/rear direction, of the vehicle when the fixed wedge 68 is assembled on the vehicle). Consequently, a gap generated between an opening portion of the vehicle body and the vehicle door in the longitudinal of the vehicle due to the bending deformation is reduced. As a result, in a case where the movable wedge 65 at a side of the vehicle at which the vehicle body shrinks moves relative to the fixed wedge 68, for example, when the vehicle makes another turn, the deformation of the vehicle body at the side of the vehicle at which the vehicle body shrinks may be restricted. Therefore, according to the vehicle door fixing apparatus having the configuration described in the first embodiment, the rattles or vibrations of the vehicle door may be minimized and rigidity of the vehicle body may be effectively increased.

As explained above, according to the first embodiment, the following effects may be obtained. (1) According to the first embodiment, the wedge member 92 is attachable and removable relative to the attachment member 91. Accordingly, for example, in a case where various types of materials exerting different frictional engagement forces relative to the movable wedge device 60 (the movable wedge 65) are applicable to the wedge member 92 due to a change of the material of the wedge member 92, one of the various materials may be selected to be applied to the wedge member 92 and the wedge member 92 made of the selected material is attached to the attachment member 91. As a result, a frictional engagement force between the movable wedge device 60 and the fixed wedge 68 may be adjusted depending on preferences of an user of the vehicle, that is, fixing strength of the vehicle door relative to the vehicle body may be arbitrarily adjusted. Alternatively, the wedge member 92 is removed from the attachment member 91; therefore, the frictional engagement between the movable wedge device 60 and the fixed wedge 68 may be eliminated depending on the preferences of the user. That is, the wedge member 92 is removed from the attachment member 91; thereby, whether to apply the fixing strength of the vehicle door relative to the vehicle body may be selected accordingly.

Moreover, for example, in a case where the various wedge members 92 including different design surfaces, for example, having different colors, are selectable, one of the wedge members 92 is selected to be thereby attached to the attachment member 91. As a result, the design of the wedge member 92 may be improved so as to suit the preference of the user.

In particular, according to the first embodiment, the wedge member 92 may be attached to and removed from the attachment member 91 while the attachment member 91 is maintained in the fixed state to the end surface D1 of the door panel D. Therefore, the wedge member 92 may be smoothly replaced with the new wedge member 92. (2) According to the first embodiment, the pair of guide rails 91*a* and the pair of guide rails 91*b* are simply configured to slidably engage with the pair of guide grooves 92*b* and the pair of guide grooves 92*c*, respectively; thereby, the wedge member 92 may be attached to and removed from the attachment member 91. As a result, the wedge member 92 may be further smoothly attached to and detached from the attachment member 91.

(3) According to the first embodiment, in a state where the wedge member 92 is arranged at the attachment position relative to the attachment member 91, the first locking portions 91*c* of the attachment member 91 are positioned in adjacent to or in contact with the second locking portions 92*h* in the aforementioned attaching direction of the wedge member 92 relative to the attachment member 91 (in the rear of the fixed wedge 68) along the sliding direction of the guide grooves 92*b* and the guide grooves 92*c* relative to the guide rails 91*a* and the guide rails 91*b*. Accordingly, in the case of attaching the wedge member 92 to the attachment member 91, the wedge member 92 is shifted to the attachment position relative to the attachment member 91 in accordance with the rearward movement of the wedge member 92 relative to the attachment member 91. At this time, the second locking portions 92*h* are engaged with the first locking portions 91*c*; thereby, the wedge member 92 is restricted from further moving rearward in the attaching direction relative to the attachment member 91. As a result, the wedge member 92 is restricted from excessively moving relative to the attachment member 91 beyond the intended attachment position in the attaching direction relative to the attachment member 91.

In addition, when the fixed wedge 68 is in the frictional engagement with the movable wedge device 60 (the movable wedge 65), the wedge member 92 may be restricted from moving relative to the attachment member 91 in the aforementioned attaching direction corresponding to a pressing direction of the movable wedge device 60 relative to the fixed wedge 68. (4) According to the first embodiment, the engagement convex portions 91*d* of the attachment member 91 are fitted to the engagement recessed portions 92*f* of the wedge member 92 when the wedge member 92 is arranged at the attachment position relative to the attachment member 91. Therefore, the wedge member 92 may be restricted from moving relative to the attachment member 91 in the aforementioned attaching direction. As a result, the wedge member 92 arranged at the attachment position relative to the attachment member 91 may be restricted from loosening from the attachment member 91.

For example, the external force exceeding the certain level is applied to the wedge member 92 attached to the attachment member 91, in the direction in which the wedge member 92 is removed from the attachment member 91. At this time, the engagement convex portions 91*d*, which may be elastically deformed by the convex portions 92*e*, move beyond the convex portions 92*e*. Consequently, the engagement convex portions 91*d* are detached from the engagement recessed portions 92*f*; therefore, the wedge member 92 attached to the attachment member 91 may be removed therefrom.

(5) According to the first embodiment, the attachment member 91 is fixedly attached to the door panel D by means of the same bolts 96 as the door lock assembly LA. Accordingly, a special attachment portion for attaching the attachment member 91 to the door panel D is not required to be provided at the door panel D. Consequently, for example, in a case where the attachment member 91 (the fixed wedge 68) is additionally attached to the door panel D after the door lock assembly LA is attached to the door panel D, man-hours required to additionally attach the attachment member 91 to the door panel D may be reduced.

(6) According to the first embodiment, the movable wedge 65 may be mounted to the vehicle body panel B together with the base plate 62 of the door lock striker 61 and the fixed wedge 68 may be mounted to the door panel D together with the door lock assembly LA. Therefore, man-hours required for assembling the vehicle door fixing apparatus as a whole, including the door lock striker 61 and the like, may be reduced.

In particular, the strength member 66 of the movable wedge 65 includes the guide groove 66*a* surrounding the shaft 63 of the door lock striker 61 so as to be opened to the fixed wedge 68 in the direction in which the door panel D is moved close to and away from the vehicle body panel B. For example, when the pair of contact members 67 of the movable wedge 65 is pressed against the fixed wedge 68, a load is applied from the pair of contact members 67 to the fixed wedge 68. Therefore, the strength member 66 may be elastically deformed in such a way that a width of an opening of the guide groove 66*a* is increased in the lateral direction of the strength member 66. However, the strength member 66 has the rigidity higher than that of the pair of contact members 67, therefore being restricted from being elastically deformed. In addition, the movement of the movable wedge 65 may be further stable.

(7) According to the first embodiment, each of the contact members 67 is configured so that the chamfered portion 67*b* and the locking tab 67*c* face portions (the chamfered portion 66*e* and the end surface of the locking portion 66*f*) of the strength member 66 in the direction in which the door panel D is moved close to and away from the vehicle body panel B. In addition, the chamfered portion 66*e* and the locking portion 66*f*, which face the chamfered portion 67*b* and the locking tab 67*c*, are sandwiched between the chamfered portion 67*b* and the locking tab 67*c* in the thickness direction of the strength member 66. As a result, the contact members 67 are restricted from being detached from the strength member 66. In addition, the contact members 67 are pressed against the fixed wedge 68; therefore, the contact members 67 may shift in a direction in which the contact members 67 separate from the fixed wedge 68. The shifting of the contact members 67 functions to increase overlaps between the chamfered portion 66*e* and the chamfered portion 67*b* and between the locking portion 66*f* and the locking tab 67*c*. Therefore, the contact members 67 may be restricted from loosening from the strength member 66, in accordance with the pressure contact of the contact members 67 with the fixed wedge 68.

(8) According to the first embodiment, each of the contact members 67 is configured so that the attachment protruding portion 67*a* is inserted in the attachment hole 66*d*, thereby being restricted from loosening in the thickness direction of the strength member 66. Therefore, the contact members 67 are restricted from being detached from the strength member 66.

(9) According to the first embodiment, the plural coil portions 76*a* (the two coil portions 76*a*) of the spring 76 are arranged side by side. For example, an external diameter (coil diameter) of each of the coil portions 76*a* of the spring 76 of the first embodiment may be reduced as compared with a case where a predetermined biasing force is obtained by means of a single coil portion of a spring. Accordingly, the size of the base plate 62 including the supporting portion 71*a* supporting the coil portions 76*a*, and the size of the cover 81 may be further reduced in the moving direction of the movable wedge 65. Consequently, even in a case where the end surface B1 of the vehicle body panel B is reduced in the vehicle width direction (for example, in a width direction of a compact vehicle), the base plate 62 (the movable wedge device 60) of the first embodiment may be arranged at the end surface B1 without interfering with the flange B2. Further, the assemblability of the base plate 62 relative to the vehicle may be increased. Furthermore, the movable wedge device 60 (the vehicle door fixing apparatus) of the first embodiment is applicable to various types of vehicles.

(10) According to the first embodiment, the recessed portions 94*a* each serving as the bearing surface for the bolt 96 for fixing the attachment member 91 to the door panel D are formed at the attachment member 91 of the fixed wedge 68. According to such configuration, the bearing surface for the bolt 96 is strengthened by metal (the metal plate of the attachment member 91). Therefore, the fixed wedge 68 may appropriately be restricted from rattling or vibrating due to creep deformation which may be caused by a bolt bearing surface, for example, made of resin.

(11) According to the first embodiment, the recessed portion 94*a* of the fixed wedge 68 configures the bearing surface for the bolt 96. The recessed portion 94*a* is configured to extend toward the end surface D1 and to be fitted to the recessed portion 97 formed at the door panel D. Therefore, the position of the fixed wedge 68 relative to the door panel D may be easily determined when fixing the fixed wedge 68 to the end surface D1, thereby increasing the assemblability of the fixed wedge 68 relative to the door panel D (the vehicle).

(12) According to the first embodiment, the spring 76 is accommodated in the cover 81 and is thereby surrounded by the cover 81. Accordingly, the spring 76 is restricted from shifting and the orientation thereof is prevented from inappropriately changing. The cover 81 configured to accommodate the spring 76 as described above is formed as a separate member from the base plate 62, therefore preventing the orientation of the spring 76 from inappropriately changing. In addition, the shape of the base plate 62 is appropriately restricted from being complicated. As a result, the formability of the base plate 62 may be restricted from deteriorating while the orientation of the spring 76 is prevented from inappropriately changing.

(13) According to the first embodiment, the supporting portion 71*a* supporting the coil portions 76*a* in the opposite direction from the direction in which the arm portions 76*b* protrude is formed at the base plate 62. In addition, the cover 81 is provided so as to support the upper and lower ends of each of the coil portions 76*a*. Therefore, the orientation of the spring 76 may be appropriately maintained.

(14) According to the first embodiment, the stepped portion 72 is arranged at the base plate 62 and the tab 83 engageable with the stepped portion 72 is arranged at the cover 81. Therefore, the cover 81 may be easily and surely fitted to the base plate 62.

(15) According to the first embodiment, the cover 81 is configured to cover the upper and lower ends of each of the coil portions 76*a* of the spring 76; thereby, the vehicle body panel B is protected from being damaged by the coil portions 76*a* because of a contact of the coil portions 76*a* with the vehicle body panel B.

(16) According to the first embodiment, the movable wedge 65 may be mounted to the vehicle body panel B at the same time as the door lock striker 61 is mounted to the vehicle body panel B. In addition, the attachment member 91 (the fixed wedge 68) may be mounted to the door panel D at the same time as the door lock assembly LA is mounted to the door panel D. As a result, the man-hours for mounting the vehicle door fixing apparatus to the vehicle may be reduced, therefore improving a working efficiency in the assembling of the vehicle door fixing apparatus relative to the vehicle.

(17) According to the first embodiment, the spring accommodating portion 71 is arranged at the rear side of the shaft 63 of the door lock striker 61 in the moving direction of the movable wedge 65; therefore, the movable wedge 65 is biased uniformly by the spring 76. In such case, the shaft 63 and the spring accommodating portion 71 are arranged at the base plate 62; therefore, the base plate 62 may be easily formed.

In addition, the vehicle door fixing apparatus according to the first embodiment may be modified as follows. According to the first embodiment, the movable wedge 65 (the movable wedge device 60) is arranged at the vehicle body panel B. Alternatively, a fixed wedge serving as the wedge device may be arranged at the vehicle body panel B.

According to the first embodiment, the guide rails 91*a* (the fixed-wedge guide rails) and the guide rails 91*b* (the fixed-wedge guide rails) are arranged at the attachment member 91 of the fixed wedge 68 and the guide grooves 92*b* (the fixed-wedge guide grooves) and the guide grooves 92*c* (the fixed-wedge guide grooves) are arranged at the wedge member 92 of the fixed wedge 68. Alternatively, a fixed-wedge guide groove for engaging with the wedge member 92 may be arranged at the attachment member 91 and a fixed-wedge guide rail for engaging with the attachment member 91 may be arranged at the wedge member 92. In addition, the number of sets of a pair formed by the fixed-wedge guide groove and the fixed-wedge guide rail may be arbitrarily determined.

According to the first embodiment, the engagement convex portions 91*d* are arranged at the attachment member 91 of the fixed wedge 68 and the engagement recessed portions 92*f* are formed at the wedge member 92 of the fixed wedge 68. Alternatively, an engagement recessed portion may be arranged at the attachment member 91 and an engagement convex portion may be arranged at the wedge member 92. In addition, the number of sets of a pair formed by the engagement convex portion and the engagement recessed portion may be arbitrarily determined.

In the first embodiment, the number of sets of a pair formed by the first locking portion 91*c* of the attachment member 91 and the second locking portion 92*h* of the wedge member 92 may be arbitrarily determined. In addition, according to the first embodiment, the attachment member 91 may be fixed to the door panel D by means of the same bolts 96 as the door lock assembly LA. Alternatively, a special bolt, which is different from the bolt 96, may be applied to fix the door lock assembly LA to the door panel D. In other words, the attachment member 91 may be arbitrarily arranged regardless of the layout of the door lock assembly LA. In addition, the number of bolts for fixing the attachment member 91 to the door panel D may be arbitrarily determined. Moreover, the attachment member 91 may be fixed to the door panel D by means of different types of fixing members (for example, pins and clips) from the bolts according to needs.

In the first embodiment, the number of coil portions 76*a* of the spring 76 may be one, or three or more. Further, in the first embodiment, the strength member 66 of the movable wedge 65 may be made of resin as long as the strength member 66 obtains the sufficient rigidity (strength). Furthermore, in the first embodiment, the pair of contact members 67 may be made of metal as long as an impact between the contact members 67 and the fixed wedge 68 is sufficiently buffered.

In the first embodiment, the attachment member 91 of the fixed wedge 68 may be made of resin as long as the attachment member 91 obtains a sufficient rigidity (strength). In addition, the wedge member 92 forming the design surface of the fixed wedge 68 may be made of metal as long as an impact between the wedge member 92 (the fixed wedge 68) and the movable wedge 65 (the movable wedge device 60) is sufficiently buffered.

According to the first embodiment, the movable wedge 65 includes the pair of contact members 67 corresponding to two members divided by the guide protruding portion 62*a* in a manner that the guide protruding portion 62*a* is positioned between the contact members 67. Alternatively, the pair of the contact members 67 may be a single contact member including a continuing portion at a rear side of the guide protruding portion 62*a*.

According to the first embodiment, the end portion of the pin P of the contact member 67, which pin P penetrates through the attachment hole 66*d* of the strength member 66, is welded into the flanged shape, thereby forming the attachment protruding portion 67*a*. As a result, the attachment protruding portion 67*a* is locked by the attachment hole 66*d* to therefore fix the contact member 67 to the strength member 66 so that the contact member 67 may not be detached from the strength member 66. Instead of the attachment protruding portion 67*a*, a clip may be utilized to fix the contact member 67 to the strength member 66 in the first embodiment.

In the first embodiment, in order to minimize rattles or vibrations to be generated at the movable wedge 65, an elastic member may be arranged in a compressed manner between a side surface of the guide rail 64 and a side surface of the guide groove 66*b* in the lateral direction of the movable wedge device 60 to close a clearance between the guide rail 64 and the guide groove 66*b*.

In the first embodiment, locking members being removable and allowing the sliding movement of the movable wedge 65 to be stopped may be utilized at a position at which the bolt holes 62*b* of the base plate 62 are exposed to the outside; thereby, the assemblability of the movable wedge device 60 relative to the vehicle body panel B is appropriately secured.

According to the first embodiment, the recessed portions 94*a* each serving the bearing surface for the bolt 96 are formed at the attachment member 91 so as to protrude toward the end surface D1 of the door panel D. However, for example, in a case where the recessed portion 97 is not formed at the door panel D so as to be in an attachment position to which the bolt 96 is attached, each of the recessed portions 94*a* needs to be formed so as not to protrude toward the end surface D1 of the door panel D.

In the first embodiment, a layer of an elastic member, for example, a silicon rubber film, may be formed on an external surface of the inclined surface 65*a* of the movable wedge 65 (the contact members 67). The elastic member has a coefficient of elasticity, which is higher than that of the resin panel (resin) forming each of the contact members 67. In such case where the layer of the elastic member is formed on the inclined surface 65*a*, for example, the inclined surface 65*a* of the movable wedge 65 is brought into contact with the inclined surface 68*a* of the fixed wedge 68 when the vehicle door is operated to the closed position. At this time, an impact energy generated due to the contact between the inclined surface 65*a* and the inclined surface 68*a* are absorbed by the elastic member, therefore restricting large vibrations from being generated between the vehicle door and the vehicle body.

According to the first embodiment, the fixed wedge 68 is configured by the attachment member 91 made of metal, and the wedge member 92 made of resin. Alternatively, both the fixed wedge 68 and the wedge member 92 may be made of resin as long as the fixed wedge 68 made of resin may sufficiently secure the strength and may sufficiently resist creep deformation. Alternatively, only a portion of the fixed wedge 68, which portion serves as a bearing surface for the bolt 96, may be formed by insert molding so as to be integrated with a metallic member for increasing the strength of the bearing surface.

According to the first embodiment, the cover 81 is configured to cover the lower end of each of the coil portions 76*a* of the spring 76. Alternatively, the cover 81 may be formed into a shape in a manner that the lower end of each of the coil portions 76*a* is uncovered, as long as the orientation of the spring 76 may be maintained.

According to the first embodiment, the cover 81 is configured to support the upper and lower ends of each of the coil portions 76*a* of the spring 76. Alternatively, the cover 81 may be configured to support one of the upper and lower ends of each of the coil portions 76*a* (the upper end facing the protruding direction of the shaft 63 and the lower end facing the opposite direction of the protruding direction of the shaft 63).

According to the first embodiment, the cover 81 is configured so as not to cover a rear side of each of the coil portions 76*a* of the spring 76. Alternatively, the cover 81 may be configured to cover the rear side of each of the coil portions 76*a*.

According to the first embodiment, the stepped portion 72 is arranged at the base plate 62 and the tab 83 engageable with the stepped portion 72 is arranged at the cover 81; thereby, the cover 81 is fixed to the base plate 62. Alternatively, the cover 81 may be fixed to the base plate 62 in a different manner from the aforementioned manner that the cover 81 is fixed to the base plate 62 by means of the stepped portion 72 and the tab 83.

According to the first embodiment, the spring accommodating portion 71 is configured by the hole formed in the base plate 62. For example, in a case where the spring 76 does not have the coiled shape, the spring accommodating portion 71 does not need to be the hole. Further, in a case where a spring accommodating portion includes a supporting portion having an accommodating portion for accommodating the spring 76, and a supporting portion for supporting the spring 76 when the spring 76 biases the movable wedge 65, the spring accommodating portion does not need to be a hole and may be formed into a polygonal shape. In addition, the spring accommodating portion may have a recessed shape.

According to the first embodiment, the movable wedge 65 is biased by the spring 76 and the spring 76 has the shape, for example, illustrated in FIG. 3. Alternatively, the shape of the spring 76 may be modified to a shape not identical to the shape illustrated in FIG. 3, and may be modified according to needs. In addition, according to the first embodiment, the movable wedge 65 may be biased by an elastic member different from the spring 76.

According to the first embodiment, the inclined surface 65*a* of the movable wedge 65 and the inclined surface 68*a* of the fixed wedge 68 are configured to be flat surfaces that do not have stepped portions. Alternatively, the inclined surface 65*a* and the inclined surface 68*a* may be formed to have stepped portions or curved surfaces.

According to the first embodiment, the movable wedge 65 is arranged at the door lock striker 61 and the fixed wedge 68 is arranged at the door lock assembly LA. Alternatively, the fixed wedge 68 may be arranged at the door lock striker 61 and the movable wedge 65 may be arranged at the door lock assembly LA. In such case, the strength member 66 of the movable wedge 65 surrounds the recess D2 in a manner that the guide groove 66*a* is opened to the fixed wedge 68 in the direction in which the door panel D is moved close to and away from the vehicle body panel B in accordance with the opening and closing operations of the vehicle door.

According to the first embodiment, the movable wedge 65 is arranged at the vehicle body panel B and the fixed wedge 68 is arranged at the door panel D. Alternatively, the movable wedge 65 may be arranged at the door panel D and the fixed wedge 68 may be arranged at the vehicle body panel B.

The vehicle door fixing apparatus according to the first embodiment is applied to the side door of the vehicle including the vehicle body configured to be completely open to air or the convertible vehicle body (i.e., the vehicle door fixing apparatus according to the first embodiment is applied to the side door of the vehicle provided with an openable or removable roof). In addition, the vehicle door fixing apparatus according to the first embodiment may be applied to any vehicle door opening and closing an opening of a vehicle body of a vehicle. The vehicle door may be a side door of the vehicle provided with a fixed roof, a side door slidable in a longitudinal direction of the vehicle, or a back door (rear gate) movable in vertical and width directions of the vehicle in a tilted manner to open and close an opening formed at a rear portion of the vehicle body.

Next, a second embodiment of the disclosure will be explained as follows with reference to the illustrations of FIG. 26 to 35. In the second embodiment, the same numbers will be assigned to the same or substantially similar components as/to those of the vehicle door fixing apparatus according to the first embodiment and detailed explanations of the same or substantially similar components as/to those of the first embodiment will be hereinafter omitted. A fixed wedge 168 according to the vehicle door fixing apparatus of the second embodiment will be described as follows. As illustrated in FIG. 27, the fixed wedge 168 includes an attachment member 191 made of, for example, a metal plate, and a wedge member 194 formed by a slide plate 192 and a wedge 193. The wedge 193 made of, for example, a resin material and being slightly smaller than the slide plate 192 is bonded to the slide plate 192 made of, for example, a metal plate. The attachment member 191 includes a groove portion 191*a* formed into a substantially rectangular shape, therefore being formed in a substantially U-shape. In addition, a direction to which the substantially U-shape of the attachment member 191 (the groove portion 191*a*) is opened corresponds to a front side of the fixed wedge 168 (the aforementioned direction is a diagonally downward left direction in FIG. 27). The opposite direction of the front side of the fixed wedge 168 corresponds to a rear side of the fixed wedge 168 (the opposite direction of the front side of the fixed wedge 168 is a diagonally upward right direction in FIG. 27).

The attachment member 191 includes a pair of guide grooves 191*b* formed at a front end portion, and a guide groove 191*c* formed at a rear end portion and being parallel to the pair of guide grooves 191*b*. The guide grooves 191*b* at the front end portion of the attachment member 191 are separated from each other by the groove portion 191*a* in a manner that the groove portion 191*a* is positioned between the guide grooves 191*b*. The guide grooves 191*b* linearly extend in the vertical direction of the vehicle body (in a state where the attachment member 191 is attached to the door panel D). The pair of guide grooves 191*b* and the guide groove 191*c* have U-shaped cross sections. Openings of the U-shaped cross sections of the guide grooves 191*b* face an opening of the U-shaped cross section of the guide groove 191*c* along a front/rear direction of the attachment member 191. In addition, each of the openings of the guide grooves 191*b* and the guide groove 191*c* continuously extends along the vertical direction of the vehicle body (in a state where the attachment member 191 is attached to the door panel D). The attachment member 191 further includes a receiving portion 191*d* receiving the fixed wedge 168. The receiving portion 191*d* is formed so as to be positioned at a substantially central portion of a lower end of the attachment member 191 (in a state where the attachment member 191 is attached to the door panel D). The receiving portion 191*d* is opened upward so as to have a substantially U-shaped cross section (in a state where the attachment member 191 is attached to the door panel D). Furthermore, the attachment member 191 includes recessed portions 191*e* formed at a rear side of the guide grooves 191*b*. Each of the recessed portions 191*e* having substantially conical shapes serves as a bearing surface for the bolt 96 (see FIG. 31) for fixing the attachment member 191 (the fixed wedge 168) to the door panel D. A bolt hole 191*f* into which the bolt 96 is inserted is formed at a substantially center of the recessed portion 191*e*. Moreover, the attachment member 191 includes an insertion hole 191*g* in which the bolt 98 (see FIG. 31) for temporarily mounting the door lock assembly LA to the door panel D is inserted. The insertion hole 191*g* is formed in a rear portion of the attachment member 191. The pair of guide grooves 191*b*, the guide groove 191*c*, and the receiving portion 191*d* are formed at an upper surface of the attachment member 191 so as to stand vertically relative to the upper surface and so as to be curved toward the upper surface.

Figure 28:
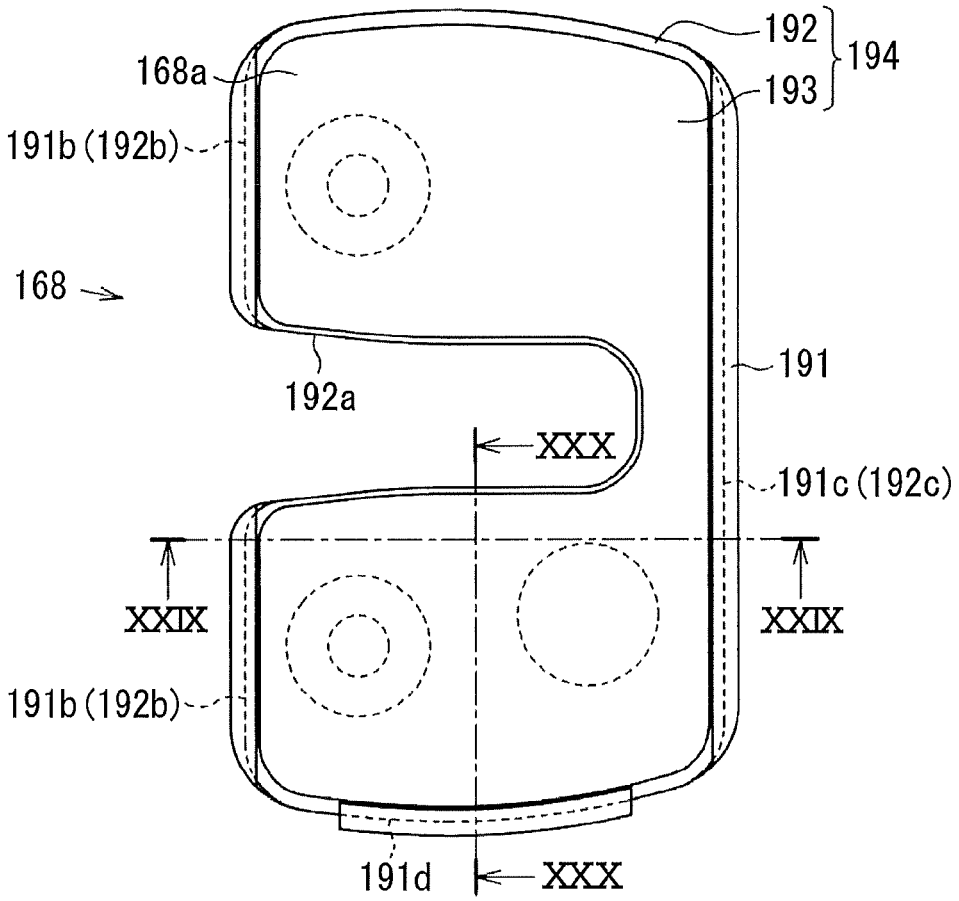
FIG. 28 is a plan view of the fixed wedge according to the second embodiment disclosed here.
Figure 29:
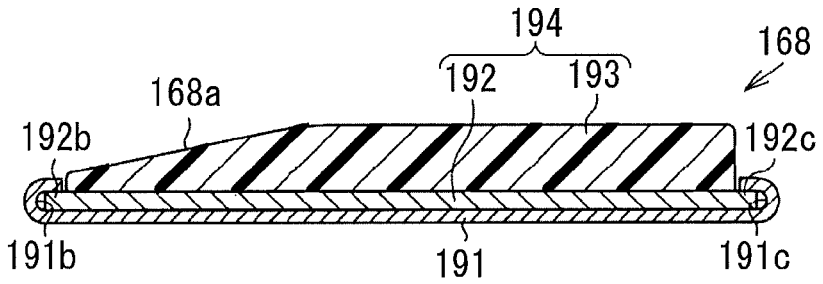
FIG. 29 is a cross-sectional view taken along the line XXIX-XXIX of FIG. 28.
Figure 30:
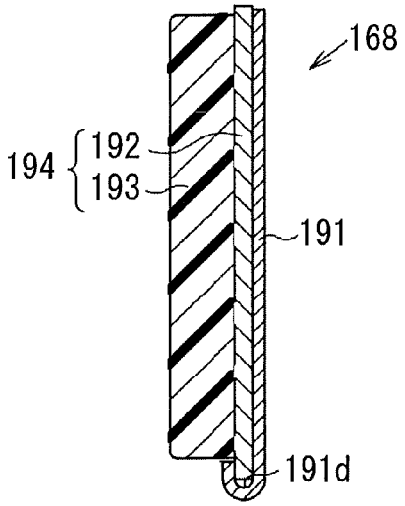
FIG. 30 is a cross-sectional view taken along the line XXX-XXX of FIG. 28.

Meanwhile, the wedge member 194 is provided attachable and removable relative to the attachment member 191. As illustrated in FIG. 28, in a state where the wedge member 194 is fixedly attached to the attachment member 191, the wedge member 194 covers the entire attachment member 191 so as to face the guide grooves 191*b* and the like. In particular, the wedge 193 forms a design surface of the fixed wedge 168. The slide plate 192 includes a slit 192*a* cut from a front side thereof so as to be formed into a substantially U-shape. The wedge 193 includes a slit 193*a* so as to be formed into a substantially U-shape. The slit 193*a* is slightly larger than the slit 192*a*. In addition, the slide plate 192 that is slightly larger than the wedge 193 includes a pair of guide rails 192*b* formed at a front end portion, and a guide rail 192*c* formed at a rear end portion. The guide rails 192*b* formed at the front end portion of the slide plate 192 are separated from each other by the slit 192*a* in a manner that the slit 192*a* is positioned between the guide rails 192*b*. The guide rails 192*b* linearly extend in the vertical direction of the vehicle body (in a state where the attachment member 191 is attached to the door panel D). The guide rail 192*c* formed at the rear end portion of the slide plate 192 is parallel to the pair of guide rails 192*b*. As illustrated in FIG. 29, the guide rails 192*b* of the slide plate 192 slidably engage with the guide grooves 191*b* of the attachment member 191, respectively, and the guide rail 192*c* of the slide plate 192 slidably engages with the guide groove 191*c* of the attachment member 191; thereby, the wedge member 194 is vertically movable relative to the attachment member 191. Accordingly, the wedge member 194 is vertically guided to be slidably attached to and slidably removed from the attachment member 191. In addition, as illustrated in FIG. 30, a substantially central portion of a lower end of the slide plate 192 (as seen in the vehicle vertical direction) is brought into contact with the receiving portion 191*d* of the attachment member 191. The substantially central portion of the lower end of the slide plate 192 is defined as a lower limit portion of the wedge member 194. Thus, the position of the wedge member 194 relative to the attachment member 191 is determined via the lower limit portion by the receiving portion 191*d* serving as a positioning mechanism.

As illustrated in FIG. 29, the fixed wedge 168 includes an inclined surface 168*a* arranged at a front portion of the wedge member 194 fixed to the attachment member 191. The inclined surface 168*a* is inclined diagonally downward from the rear side to the front side of the fixed wedge 168. In other words, as being inclined toward the front side of the fixed wedge 168, the inclined surface 168*a* becomes close to the attachment member 191 in a thickness direction thereof.

In the case of assembling the fixed wedge 168, as illustrated in FIG. 27, firstly, when moving the wedge member 194 from an upper side of the attachment member 191 to the lower side of the attachment member 191 along the vehicle vertical direction, the guide rails 192*b* of the wedge member 194 (the slide plate 192) slide along the guide grooves 191*b* of the attachment member 191, and the guide rail 192*c* of the wedge member 194 (the slide plate 192) slides along the guide groove 191*c* of the attachment member 191 as shown in FIG.

28. Then, the substantially central portion of the lower end of the wedge member 194 is brought into contact with the receiving portion 191*d* of the attachment member 191 in accordance with the sliding movement of the wedge member 194 relative to the attachment member 191; therefore, the assembling of the fixed wedge 168 is completed.

Figure 31:
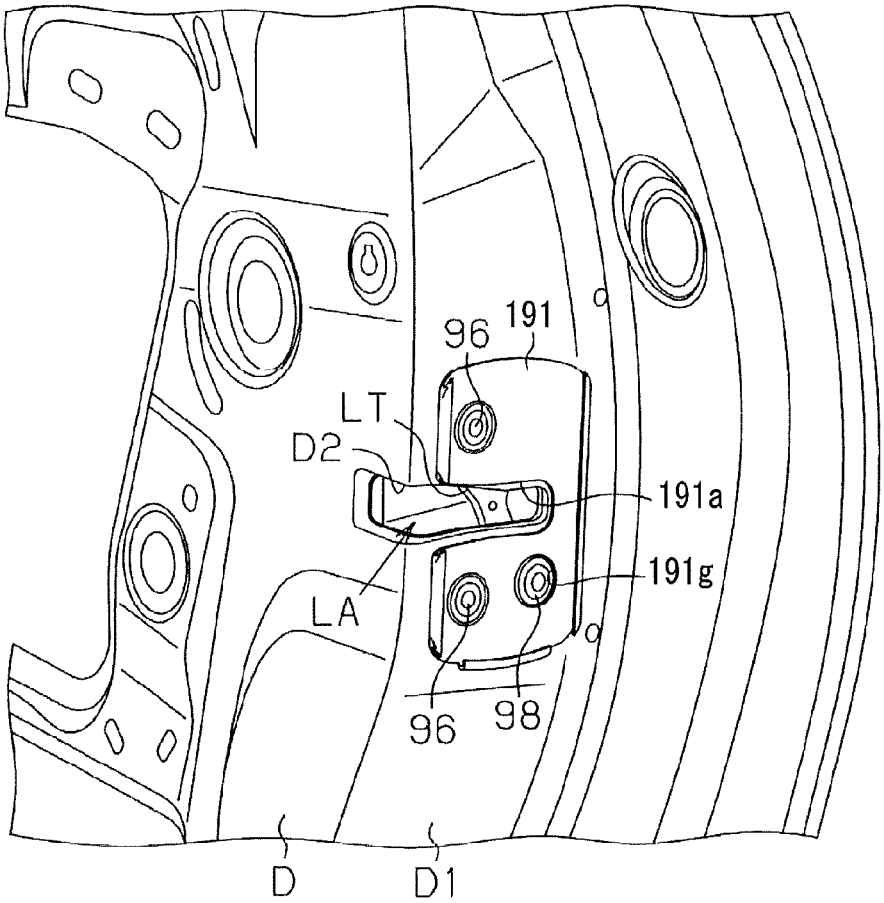
FIG. 31 is a perspective view illustrating a state where an attachment member of the fixed wedge according to the second embodiment disclosed here is attached to the door panel.
Figure 33:
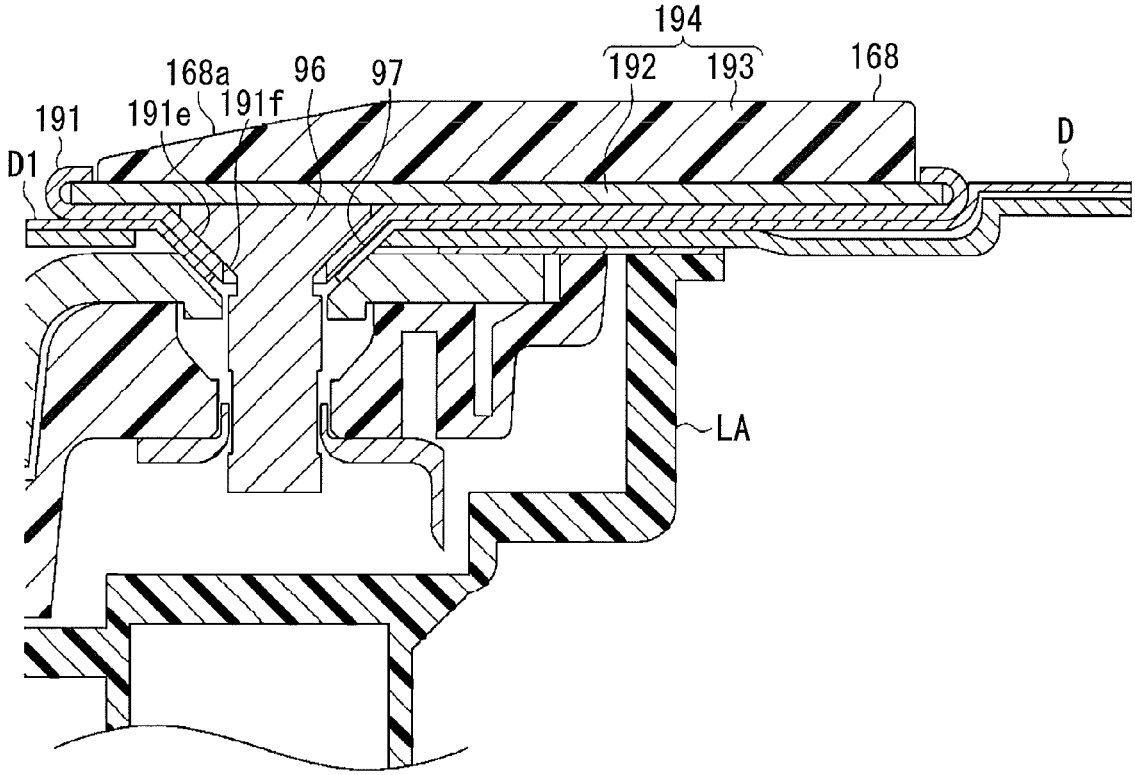
FIG. 33 is a cross-sectional side view illustrating a state where the fixed wedge according to the second embodiment disclosed here is assembled on the door panel.

In addition, in order to mount the fixed wedge 168 to the door panel D (the end surface D1), firstly, the attachment member 191, without the wedge member 194 attached thereto, is fixedly attached to the end surface D1 as illustrated in FIG. 31. At this time, the attachment member 191 is attached to the door panel D together with the door lock assembly LA, which is temporarily attached to the door panel D so as to be positioned at the opposite side of the attachment member 191 relative to the door panel D. In other words, the door lock assembly LA is tightened to the door panel D in advance so as to be positioned at the opposite side of the attachment member 191 relative to the door panel D, by means of the bolt 98 inserted into the insertion hole 191*g* so as not to interfere with the attachment member 191. In addition, the attachment member 191 is fixedly attached to the end surface D1 together with the door lock assembly LA by means of the bolts 96 each serving as the fixing member. In a state where the attachment member 191 is attached to the end surface D1, the groove portion 191*a* of the attachment member 191 surrounds the portion of the recess D2 formed in the door panel D so as to receive the door lock striker 61 (the portion of the recess D2 extends in the vehicle width direction). In particular, the groove portion 191*a* surrounds the portion of the recess D2 while keeping a certain distance relative to the recess D2. The shaft 63 of the door lock striker 61 is inserted in and removed from the recess D2. In addition, as illustrated in FIG. 33, the recessed portion 191*e* of the attachment member 191 of the fixed wedge 168, which recessed portion 191*e* protrudes toward the end surface D1, is configured to be fitted to the recessed portion 97 formed at the door panel D.

Figure 32:
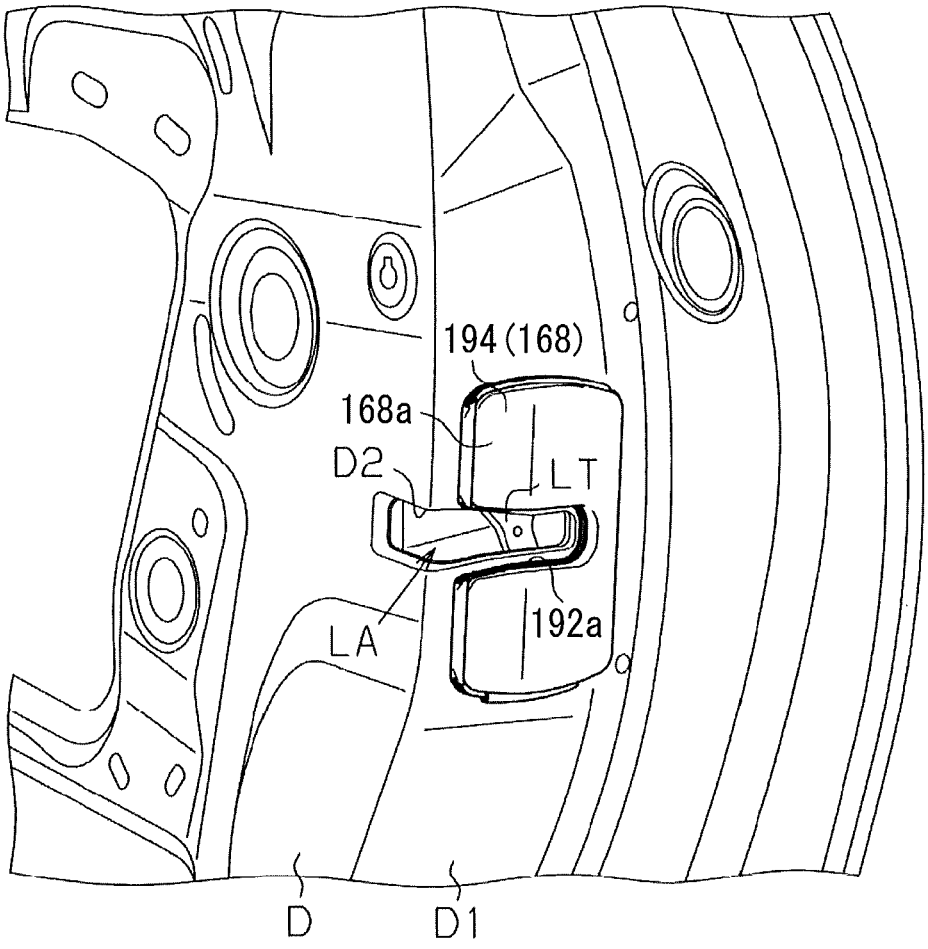
FIG. 32 is a perspective view illustrating a state where the fixed wedge of the second embodiment disclosed here is assembled on the door panel.

As shown in FIG. 32, the wedge member 194 is fixedly attached to the attachment member 191 secured to the end surface D1 in the manner described above. In such condition where the wedge member 194 is attached to the attachment member 191, the substantially entire attachment member 191 is covered by the wedge member 194, thereby being restricted from being exposed to the outside. In addition, the bolts 96 for fixing the attachment member 191 to the door panel D are also restricted from being exposed to the outside. Moreover, an area of an outer surface of the wedge 193 forming the design surface of the wedge member 194 may be increased to a size by which the wedge 193 completely covers the pair of guide grooves 191*b*, the guide groove 191*c*, and the receiving portion 191*d* of the attachment member 191. In particular, the outer surface of the wedge 193 may be configured so that the attachment member 191 is completely restricted from being exposed to the outer side, as long as the guide rails 192*b* and the guide rail 192*c* of the slide plate 192 are slidable relative to the guide grooves 191*b* and the guide groove 191*c* of the attachment member 191, respectively.

Figure 26:
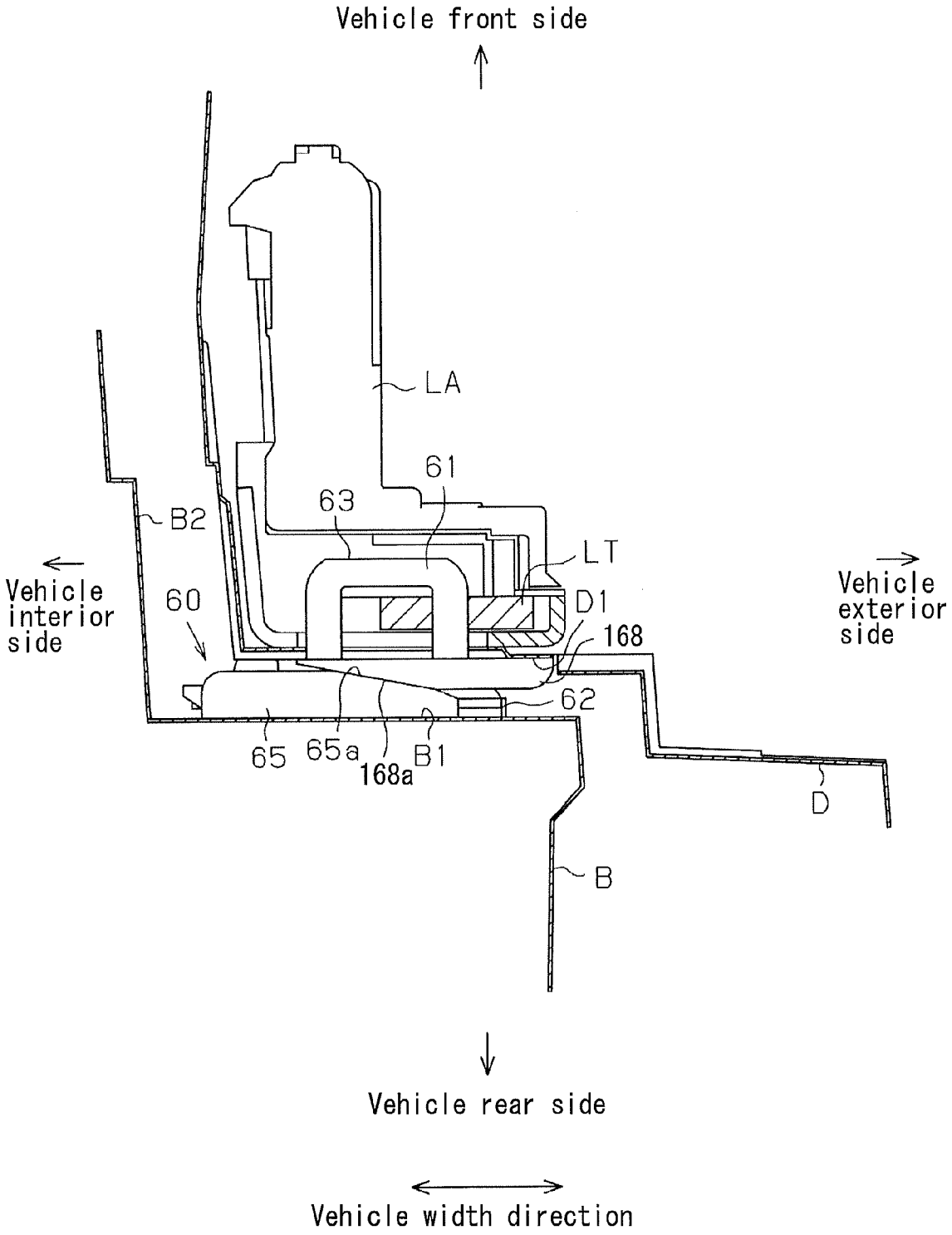
FIG. 26 a cross-sectional side view of the vehicle door fixing apparatus according to a second embodiment disclosed here.
Figure 27:
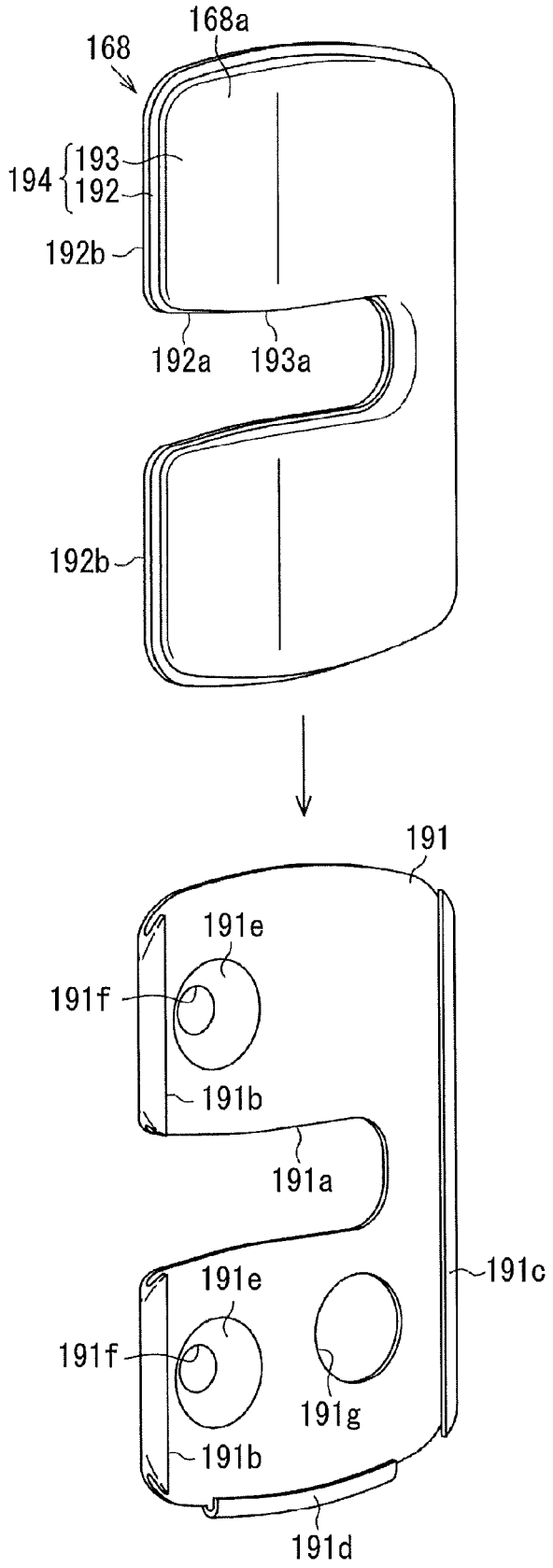
FIG. 27 is an exploded perspective view of a fixed wedge to be provided at the vehicle door fixing apparatus according to the second embodiment disclosed here.

According to the fixed wedge 168 having the above-described configuration, as illustrated in FIGS. 26 and 32, in a state where the fixed wedge 168 is attached to the end surface D1, a direction (an extending direction) in which the slit 192*a* extends (i.e., a front/rear direction of the fixed wedge 168) coincides with the direction in which the door panel D is moved close to and away from the vehicle body panel B in accordance with the opening and closing operations of the vehicle door. That is, the extending direction of the slit 192*a* corresponds to the vehicle width direction in a state where the vehicle door is closed. Therefore, the slit 192*a* of the fixed wedge 168 (the wedge member 194) is formed in a shape that matches the shape of the portion of the recess D2, which portion extends in the width direction of the recess D2 (in the vehicle width direction in a state where the vehicle door is closed). In other words, the fixed wedge 168 is configured so that the slit 192*a* surrounds the recess D2 to be opened to the movable wedge device 60 in the direction in which the door panel D is moved close to and away from the vehicle body panel B in accordance with the opening and closing operations of the vehicle door. In addition, the inclined surface 168*a* is inclined relative to the body panel B so as to become close to the end surface D1 toward the direction in which the door panel D is moved close to the vehicle body panel B in accordance with the closing operation of the vehicle door (i.e., the inclined surface 168*a* is inclined relative to the body panel B so as to become close to the end surface D1 toward the interior side of the vehicle in the vehicle width direction).

According to the vehicle door fixing apparatus of the second embodiment, as illustrated in FIG. 26, the inclined surface 65*a* of the movable wedge 65 and the inclined surface 168*a* of the fixed wedge 168 (the wedge member 194) are in pressure contact with each other in a state where the vehicle door is closed.

Here, an operation of the vehicle door fixing apparatus of the second embodiment will be described. According to the vehicle door fixing apparatus of the second embodiment, in a state where the vehicle door is closed, the inclined surface 65*a* of the movable wedge 65 slidably provided in a reciprocating manner relative to the vehicle body panel B, is in contact with the inclined surface 168*a* of the fixed wedge 168 fixedly attached to the door panel D (see FIG. 26). At this time, the movable wedge 65 is pressed against the fixed wedge 168 by the biasing force of the spring 76; therefore, the vehicle door is pressed toward the hinge of the vehicle door. As a result, rattles or vibrations of the vehicle door are restricted.

Figure 34:
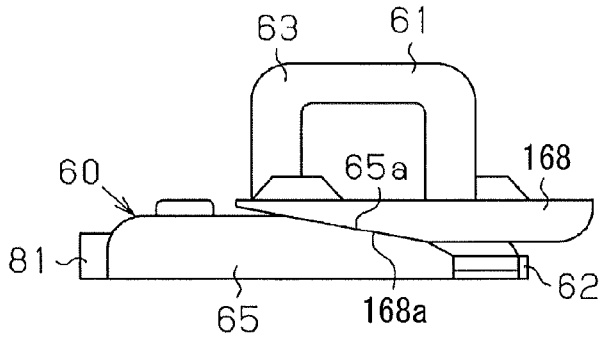
FIG. 34 is a side view illustrating a state where the movable wedge device and the fixed wedge of the vehicle door fixing apparatus according to the second embodiment when the vehicle body is not deformed.
Figure 35:
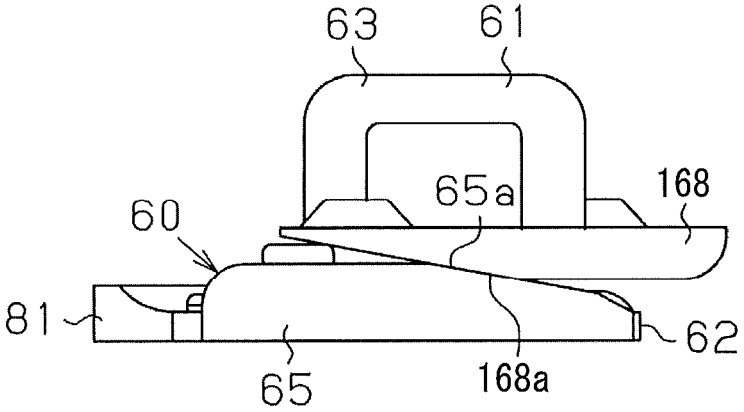
FIG. 35 is a side view illustrating a state where the movable wedge device and the fixed wedge of the vehicle door fixing apparatus according to the second embodiment when the vehicle body is deformed.
Figure 36:
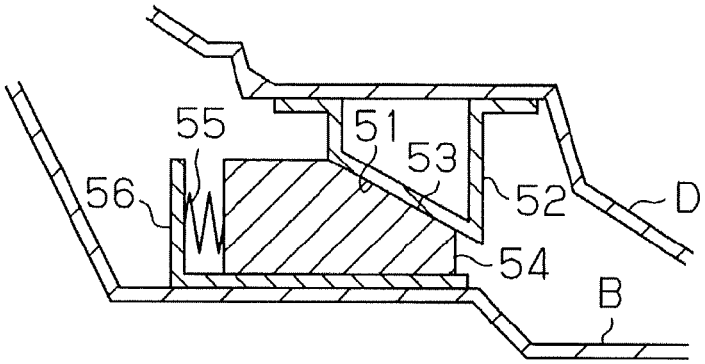
F I G. 36 Prior Art
FIG. 36 is a cross-sectional side view of a known vehicle door fixing apparatus.

In a case where a bending deformation occurs to the vehicle body in the width direction thereof (in the right/left direction thereof), for example, when the vehicle makes a turn, the movable wedge 65 at a side of the vehicle at which the vehicle body expands moves relative to the fixed wedge 168 in the right direction when viewed in FIG. 34. At this time, the movable wedge 65 in a state illustrated in FIG. 34 moves to a state illustrated in FIG. 35; thus, the fixed wedge 168 moves upward when viewed in FIG. 34 (that is, in the longitudinal direction, i.e. the front/rear direction, of the vehicle when the fixed wedge 168 is assembled on the vehicle). Consequently, a gap generated between the opening portion of the vehicle body and the vehicle door in the longitudinal of the vehicle due to the bending deformation is reduced. As a result, in a case where the movable wedge 65 at a side of the vehicle at which the vehicle body shrinks moves relative to the fixed wedge 168, for example, when the vehicle makes another turn, the deformation of the vehicle body at the side of the vehicle at which the vehicle body shrinks may be restricted. Therefore, according to the vehicle door fixing apparatus having the configuration described in the second embodiment, the rattles or vibrations of the vehicle door may be minimized and the rigidity of the vehicle body may be effectively increased.

Next, functions of the vehicle door fixing apparatus according to the second embodiment will be explained as follows. In a state where the vehicle door is mounted to the vehicle body, the guide grooves 191*b* and the guide groove 191*c* of the attachment member 191 fixed to the door panel D are arranged so as to extend vertically, that is, along the vehicle vertical direction. In addition, the guide rails 192*b* and the guide rail 192*c* of the wedge member 194 (the slide plate 192) engage with the guide grooves 191*b* and the guide groove 191*c*, respectively. Accordingly, the wedge member 194 is restricted from moving relative to the attachment member 191 in the vehicle longitudinal and width directions. In addition, the wedge member 194 is retained at an attachment completion position relative to the attachment member 191 by the receiving portion 191*d* of the attachment member 191, thereby being restricted from moving further downward beyond the attachment position.

On the other hand, when the vehicle door mounted to the vehicle body is being operated to the opened and closed positions, the moving direction of the vehicle door corresponds to the vehicle width direction, that is, the horizontal direction of the vehicle. In other words, a guide mechanism formed by the guide grooves 191*b* and the guide groove 191*c* of the attachment member 191 and by the guide rails 192*b* and the guide rail 192*c* of the wedge member 194 is set along the vehicle vertical direction. The moving direction of the vehicle door is identical to the vehicle width direction. Thus, the attaching and removing directions of the wedge member 194 relative to the attachment member 191 are set to be different from the moving direction of the vehicle door relative to the vehicle body. Accordingly, when the vehicle door is being operated to the opened and closed positions, the wedge member 194 may be appropriately maintained in the attached state relative to the attachment member 191 by the engaged state established by the aforementioned guide mechanism.

As described above, according to the second embodiment, the following effects may be obtained. (1) According to the second embodiment, the fixed wedge 168 is not configured by a single component but is configured by separate components of the attachment member 191 and the wedge member 194. Therefore, the wedge member 194 may be smoothly attached to and detached from the attachment member 191 by means of the aforementioned guide mechanism formed by the attachment member 191 and the wedge member 194.

(2) According to the second embodiment, in order to adjust a frictional engagement force of the fixed wedge 168 with the movable wedge device 60, the wedge member 194 that may exert the desired frictional engagement force is selected and is thereafter fitted to the attachment member 191; thereby, the frictional engagement force of the fixed wedge 168 with the movable wedge device 60 may be easily adjusted. In other words, the fixing strength of the vehicle door relative to the vehicle body may be easily adjusted.

(3) According to the second embodiment, the attaching and removing directions of the wedge member 194 relative to the attachment member 191 are established to be different from the moving direction of the vehicle door relative to the vehicle body. Therefore, the wedge member 194 may be restricted from being accidentally detached from the attachment member 191, for example, when the vehicle door is being operated to the closed and opened positions.

(4) According to the second embodiment, the wedge member 194 is removed from the attachment member 191; thereby, the frictional engagement between the movable wedge device 60 and the fixed wedge 168 may be eliminated depending on preferences of the user. In other words, the wedge member 194 is removed from the attachment member 191; thereby, the fixing strength of the vehicle door relative to the vehicle body by the vehicle door fixing apparatus may be selectively adjusted.

(5) According to the second embodiment, the material, especially for the wedge 193 of the wedge member 194 is changed; thereby, the fixing strength of the vehicle door relative to the vehicle body may be increased and decreased. In addition, abnormal noises generated by the opening and closing operations of the vehicle door may be minimized. (6) According to the second embodiment, the thickness of the wedge 193 is changed; thereby, the fixing strength of the vehicle door relative to the vehicle body may be increased and decreased. In addition, the abnormal noises generated by the opening and closing operations of the vehicle door may be minimized.

(7) According to the second embodiment, a color of the wedge 193 is changed; thereby, the specification of the fixed wedge 168, satisfying preferences of the user may be established, that is, the design of the fixed wedge 168 may be easily changed. (8) According to the second embodiment, the wedge member 194 may be smoothly attached to or removed from the attachment member 191 by means of the aforementioned guide mechanism relatively easily or simply configured by the guide grooves 191*b* and the guide groove 191*c* of the attachment member 191 and by the guide rails 192*b* and the guide rail 192*c* of the wedge member 194. Therefore, working efficiencies in the attaching and removing operations (including replacement) of the wedge member 194 may improve.

(9) When fitting the wedge member 194 to the attachment member 191, the downward movement of the wedge member 194 in the vehicle vertical direction may be stopped at the attachment completion position relative to the attachment member 191 by the receiving portion 191*d* of the attachment member 191. In other words, the wedge member 194 may be restricted from excessively moving in the vehicle vertical direction; therefore, the vehicle door may be fixed to the vehicle body in an appropriate manner in accordance with the frictional engagement between the fixed wedge 168 and the movable wedge device 60 when the wedge member 194 is at the attachment completion position.

(10) According to the second embodiment, the receiving portion 191*d* is arranged at a lowermost position of the attachment member 191 in a direction in which the wedge member 194 is attached to the attachment member 191 (the direction will be referred to as an attaching direction). The receiving portion 191*d* is opened toward an upstream side in the attaching direction. The wedge member 194 is brought into contact with an inner surface of the receiving portion 191*d*, which inner surface is positioned at a downstream side relative to the opening of the receiving portion 191*d* in the attaching direction. The receiving portion 191*d* limits the movement of the wedge member 194 relative to the attachment member 191 along the attaching direction. Therefore, when attaching the wedge member 194 to the attachment member 191 along the attaching direction, the wedge member 194 is brought into contact with the inner surface of the receiving portion 191*d* arranged at the lowermost position of the attachment member 191; thereby, the position of the wedge member 194 relative to the attachment member 191 is determined. As a result, the vehicle door may be appropriately fixed relative to the vehicle door in accordance with the frictional engagement between the wedge member 194 and the movable wedge device 60 when the wedge member 194 is in contact with the receiving portion 191*d* arranged at the lowermost position in the attaching direction.

(11) According to the second embodiment, the attachment member 191 is fixedly attached to the door panel D by the bolts 96. Therefore, the wedge member 194 is detached from the attachment member 191; thereafter, the bolts 96 are exposed to the outer side and are removed from the attachment member 191. Consequently, the whole fixed wedge 168 may be removed from the door panel D to be therefore replaced with the new fixed wedge 168. In addition, only the attachment member 191 is replaced with the new attachment member 191; thereafter, the wedge member 194 initially attached to the attachment member 191 may be attached to the new attachment member 191.

(12) The wedge member 194 is provided attachable and removable relative to the attachment member 191. Only the wedge member 194 may be detached from the attachment member 191 while the attachment member 191 is maintained in the attached state relative to the door panel D. In other words, a component to be replaced by a new component may be limited to the wedge member 194 in the whole fixed wedge 168; thereby, component replacement costs to be imposed to the user may be reduced.

In addition, the vehicle door fixing apparatus according to the second embodiment may be modified as follows. According to the second embodiment, the vehicle door fixing apparatus includes the movable wedge device 60 arranged at the vehicle body panel B, and the fixed wedge 168 provided with the attachment member 191 attached to the door panel D. Alternatively, the vehicle door fixing apparatus may include the fixed wedge 168 provided with the attachment member 191 attached to the vehicle body panel B, and the movable wedge device 60 arranged at the door panel D. In addition, for example, in a case where the vehicle door fixing apparatus including the single movable wedge device 60 and the single fixed wedge 168 is defined as a fixing apparatus set, two or more fixing apparatus sets may be mounted on the vehicle. In such case where the two fixing apparatus sets (first and second fixing apparatus sets) are mounted on the vehicle, the movable wedge device 60 and the fixed wedge 168, which configure the first fixing apparatus set, may be arranged at the vehicle body panel B and the door panel D, respectively. Meanwhile, the movable wedge device 60 and the fixed wedge 168, which configure the second fixing apparatus set, may be arranged at the door panel D and the vehicle body panel B, respectively.

According to the second embodiment, the guide mechanism is configured by the pair of guide grooves 191*b* and the guide groove 191*c* that are arranged at the attachment member 191, and by the pair of guide rails 192*b* and the guide rail 192*c* that are arranged at the wedge member 194. Alternatively, the guide mechanism may be configured by a guide rail arranged at the attachment member 191 and a guide groove arranged at the wedge member 194. In addition, for example, in a case where the guide mechanism configured by a group of the guide grooves 191*b* and the guide groove 191*c* and by a group of the guide rails 192*b* and the guide rail 192*c* is defined as a guide mechanism set, the fixed wedge 168 may be provided with two or more than two guide mechanism sets. In such case where the fixed wedge 168 is provided with the two guide mechanism sets (first and second guide mechanism sets), the guide grooves 191*b* and the guide groove 191*c* that configure the first guide mechanism set may be arranged at the attachment member 191 while the guide rails 192*b* and the guide rail 192*c* that configure the first guide mechanism set may be arranged at the wedge member 194. Further, the guide rails 192*b* and the guide rail 192*c* that configure the second guide mechanism set may be arranged at the attachment member 191 while the guide grooves 191*b* and the guide groove 191*c* that configure the second guide mechanism set may be arranged at the wedge member 194.

According to the second embodiment, the receiving portion 191*d* serving as the positioning mechanism is arranged at the attachment member 191 to determine the position of the wedge member 194 relative to the attachment member 191. Instead of or in addition to the positioning mechanism, a hanging portion may be arranged at the slide plate 192 of the wedge member 194. The hanging portion serving as the positioning mechanism is arranged at an uppermost position of the slide plate 192 (the wedge member 194) in the attaching direction of the wedge member 194 relative to the attachment member 191 so as to be opened toward a downstream side in the attaching direction. An inner surface of the hanging portion is positioned at an upstream side of the opening of the hanging portion in the attaching direction. The inner surface of the hanging portion is brought into contact with the attachment member 191. Therefore, the wedge member 194 is restricted by the hanging portion from moving in the attaching direction in accordance with the attaching of the wedge member 194 to the attachment member 191. According to the aforementioned configuration of the hanging portion, when attaching the wedge member 194 to the attachment member 191, the inner surface of the hanging portion arranged at the uppermost position of the wedge member 194 is brought into contact with the attachment member 191; thereby, the position of the wedge member 194 relative to the attachment member 191 is determined. As a result, the vehicle door may be appropriately fixed relative to the vehicle body in accordance with the frictional engagement between the wedge member 194 and the movable wedge device 60 when the hanging portion arranged at the uppermost position of wedge member 194 is in contact with the attachment member 191.

According to the second embodiment, the attachment member 191 is made of metal in consideration of the durability thereof. Alternatively, the attachment member 191 may be made of hard resin. Moreover, according to the second embodiment, the wedge member 194 is configured by the slide plate 192 and the wedge 193 that is bonded to the slide plate 192. Alternatively, the wedge member 194 may be formed by a single component. Further, the wedge member 194 formed by the single component may configure the guide mechanism in conjunction with the attachment member 191 and may form the design surface. In such case, the wedge member 194 formed by the single component may be made of metal or hard resin. In addition, in a case where the wedge member 194 is configured by two different components of the slide plate 192 and the wedge 193, the slide plate 192 made of metal may be integrally formed with a resin material (the wedge 193) by insert molding to thereby form the wedge member 194. Alternatively, two different resin materials each having adhesiveness may be utilized to form the two-colored wedge member 194.

A major portion of the second embodiment is in that the fixed wedge 168 constituting a component of the vehicle door fixing apparatus and is described as above; however, various modifications may be applied to the movable wedge device 60 corresponding to a mating portion of the fixed wedge 168. For example, in a case where the wedge 193 of the fixed wedge 168 is made of metal, it is appropriate for the contact members 67 of the movable wedge device 60 to be made of not metal but resin in order to prevent abnormal noises from being generated. Moreover, for example, in a case where the inclined surface 168*a* of the fixed wedge 168 is formed by a stepped portion or a curved surface instead of being formed by a flat surface which is stepless, the inclined surface 65*a* of the movable wedge device 60 may be formed by a stepped portion or a curved surface so as to conform to the stepped portion or the curved surface of the inclined surface 168*a* of the fixed wedge 168. Thus, shapes, materials, or the like of components of the movable wedge device 60 are changed in consideration for the frictional engagement between the movable wedge device 60 and the fixed wedge 168; thereby, the vehicle door may be fixed to the vehicle body in an appropriate manner.

The vehicle door fixing apparatus according to the second embodiment is applied to the side door of the vehicle including the vehicle body configured to be completely open to air or the convertible vehicle body (i.e., the vehicle door fixing apparatus according to the second embodiment is applied the side door of the vehicle provided with an openable or removable roof). In addition, the vehicle door fixing apparatus according to the second embodiment may be applied to any vehicle door opening and closing an opening of a vehicle body of a vehicle. The vehicle door may be a side door of the vehicle provided with a fixed roof, a side door slidable in a longitudinal direction of the vehicle, or a back door (rear gate) movable in vertical and width directions of the vehicle in a tilted manner to open and close an opening formed at a rear portion of the vehicle body. In such case, the fixed wedge 168 including the attachment member 191 fixedly attached to one of the door panel D and the vehicle body panel B, and the wedge member 194 provided attachable and removable relative to the attachment member 191, include the guide mechanism guiding the wedge member 194 to be attached to and removed from the attachment member 191 along the direction different from the moving direction of the vehicle door relative to the vehicle body.

As described above, according to the aforementioned embodiments, the vehicle door fixing apparatus includes the fixed wedge 68, 168 configured to be fixed to one of the vehicle body panel B and the door panel D, and the movable wedge device 60 configured to be fixed to the other of the vehicle body panel B and the door panel D. The fixed wedge 68, 168 includes the attachment member 91, 191 configured to be attached to the vehicle body panel B or the door panel D, and the wedge member 92, 194 provided to be pressure contactable with the movable wedge device 60 and being attachable and removable relative to the attachment member 91, 191, the wedge member 92, 194 forming the design surface of the fixed wedge 68, 168.

According to the aforementioned configuration, the wedge member 92 is attachable and removable relative to the attachment member 91. Therefore, for example, in a case where various types of materials exerting different frictional engagement forces relative to the movable wedge device 60 (the movable wedge 65) are applicable to the wedge member 92 due to a change of the material of the wedge member 92, one of the various materials may be selected to be applied to the wedge member 92 and the wedge member 92 made of the selected material is attached to the attachment member 91. As a result, the frictional engagement force between the movable wedge device 60 and the fixed wedge 68 may be adjusted depending on preferences of the user of the vehicle, that is, the fixing strength of the vehicle door relative to the vehicle body may be arbitrarily adjusted. Alternatively, the wedge member 92 is removed from the attachment member 91; therefore, the frictional engagement between the movable wedge device 60 and the fixed wedge 68 may be eliminated depending on the preferences of the user.

According to the aforementioned first embodiment, the fixed wedge 68 includes the fixed-wedge guide rails 91*a*, 91*b* arranged at one of the attachment member 91 and the wedge member 92, and the fixed-wedge guide grooves 92*b*, 92*c* arranged at the other of the attachment member 91 and the wedge member 92. The fixed-wedge guide grooves 92*b*, 92*c* slidably engage with the fixed-wedge guide rails 91*a*, 91*b* to guide the wedge member 92 to be attached to and removed from the attachment member 91.

According to the aforementioned configuration, the pair of fixed-wedge guide rails 91*a* and the pair of fixed-wedge guide rails 91*b* are simply configured to slidably engage with the pair of fixed-wedge guide grooves 92*b* and the pair of fixed-wedge guide grooves 92*c*, respectively; thereby, the wedge member 92 may be guided to be attached to and removed from the attachment member 91. In addition, the wedge member 92 may be further smoothly attached to and detached from the attachment member 91.

According to the aforementioned first embodiment, the fixed wedge 68 includes the first locking portions 91*c* arranged at the attachment member 91, and the second locking portions 92*h* arranged at the wedge member 92. The second locking portions 92*h* are adjacent to or in contact with the first locking portions 91*c* in the attaching direction of the wedge member 92 relative to the attachment member 91 along the sliding direction of the fixed-wedge guide rails 91*a*, 91*b* and the fixed-wedge guide grooves 92*b*, 92*c* in a state where the wedge member 92 is at the attachment position relative to the attachment member 91.

According to the aforementioned configuration, in the case of attaching the wedge member 92 to the attachment member 91, the wedge member 92 is shifted to the attachment position relative to the attachment member 91 in accordance with the movement of the wedge member 92 relative to the attachment member 91. Therefore, the second locking portions 92*h* are engaged with the first locking portions 91*c*; thereby, the wedge member 92 is restricted from further moving in the attaching direction relative to the attachment member 91. As a result, the wedge member 92 is restricted from excessively moving beyond the intended attachment position in the attaching direction relative to the attachment member 91.

According to the aforementioned first embodiment, the fixed wedge 68 includes the engagement convex portions 91*d* arranged at one of the attachment member 91 and the wedge member 92, and the engagement recessed portions 92*f* arranged at the other of the attachment member 91 and the wedge member 92. In a state where the wedge member 92 is at the attachment position relative to the attachment member 91, the engagement recessed portions 92*f* are fitted to the engagement convex portions 91*d* to restrict the wedge member 92 from moving in the removing direction of the wedge member 92 relative to the attachment member 91 along the sliding direction of the fixed-wedge guide rails 91*a*, 91*b* and the fixed-wedge guide groove 92*b*, 92*c*.

According to the aforementioned configuration, the engagement convex portions 91*d* of the attachment member 91 are fitted to the engagement recessed portions 92*f* of the wedge member 92 when the wedge member 92 is arranged at the attachment position relative to the attachment member 91. Therefore, the wedge member 92 may be restricted from moving relative to the attachment member 91 in the aforementioned attaching direction. As a result, the wedge member 92 arranged at the attachment position relative to the attachment member 91 may be restricted from loosening from the attachment member 91.

According to the aforementioned first embodiment, the attachment member 91 is configured to be attached to the vehicle body panel B or the door panel D together with the door lock assembly LA by the same bolts 96. The door lock assembly LA is engageable with the door lock striker 61 fixed to the vehicle body panel B or the door panel D at which the movable wedge device 60 is arranged.

According to the aforementioned configuration, the special attachment portion for attaching the attachment member 91 to the door panel D is not required to be provided at the door panel D. Consequently, for example, in a case where the attachment member 91 (the fixed wedge 68) is additionally attached to the door panel D after the door lock assembly LA is attached to the door panel D, the man-hours required to additionally attach the attachment member 91 to the door panel D may be reduced.

According to the aforementioned second embodiment, the fixed wedge 168 includes the guide mechanism guiding the wedge member 194 to be attached to and removed from the attachment member 191 along the direction that is different from the moving direction of the vehicle door relative to the vehicle body.

According to the aforementioned configuration, the fixed wedge 168 is not configured by a single component but is configured by separate components of the attachment member 191 and the wedge member 194. Therefore, the wedge member 194 may be smoothly attached to and detached from the attachment member 191 by the guide mechanism. Thus, in order to adjust the frictional engagement force of the fixed wedge 168 with the movable wedge device 60, the wedge member 194 that may exert the desired frictional engagement force is selected and is thereafter fitted to the attachment member 191; thereby, the frictional engagement force of the fixed wedge 168 with the movable wedge device 60 may be easily adjusted. In other words, the fixing strength of the vehicle door relative to the vehicle body may be easily adjusted. In addition, the attaching and removing directions of the wedge member 194 relative to the attachment member 191 are established to be different from the moving direction of the vehicle door relative to the vehicle body. Therefore, the wedge member 194 may be restricted from being accidentally detached from the attachment member 191.

According to the aforementioned second embodiment, the guide mechanism includes the guide grooves 191*b*, 191*c* arranged at one of the attachment member 191 and the wedge member 194 and extending along the direction that is different from the moving direction of the vehicle door relative to the vehicle body, and the guide rails 192*b*, 192*c* arranged at the other of the attachment member 191 and the wedge member 194. The guide rails 192*b*, 192*c* slide relative to the guide grooves 191*b*, 191*c* to guide the wedge member 194 to be attached to and removed from the attachment member 191 along the direction that is different from the moving direction of the vehicle door relative to the vehicle body.

According to the aforementioned configuration, the wedge member 194 may be smoothly attached to or removed from the attachment member 191 by the guide mechanism relatively easily configured by the guide grooves 191*b* and the guide groove 191*c* of the attachment member 191 and by the guide rails 192*b* and the guide rail 192*c* of the wedge member 194. Therefore, working efficiencies in the attaching and removing operations (including replacement) of the wedge member 194 may improve.

According to the aforementioned second embodiment, the fixed wedge 168 includes the positioning mechanism stopping the movement of the wedge member 194 at the attachment completion position relative to the attachment member 191 when the wedge member 194 is being attached to the attachment member 191 in the direction in which the wedge member 194 is guided by the guide mechanism.

According to the aforementioned configuration, in the case of fitting the wedge member 194 to the attachment member 191, the movement of the wedge member 194 may be stopped at the attachment completion position by the positioning mechanism. In other words, the wedge member 194 may be restricted from excessively moving; therefore, the vehicle door may be fixed to the vehicle body in an appropriate manner in accordance with the frictional engagement between the wedge member 194 of the fixed wedge 168 and the movable wedge device 60 when the wedge member 194 is at the attachment completion position.

According to the aforementioned second embodiment, the vehicle door fixing apparatus further includes the receiving portion 191*d* provided at the lowermost position in the attaching direction of the wedge member 194 relative to the attachment member 191. The receiving portion 191*d* includes the opening opened toward the upstream side in the attaching direction and the inner surface positioned at the downstream side of the opening in the attaching direction. The receiving portion 191*d* brings the inner surface into contact with the wedge member 194 to restrict the wedge member 194 from moving in accordance with the attaching of the wedge member 194 to the attachment member 191 in the attaching direction.

According to the aforementioned configuration, in the case of attaching the wedge member 194 to the attachment member 191, the wedge member 194 is brought into contact with the inner surface of the receiving portion 191*d* arranged at the lowermost position of the attachment member 191; thereby, the position of the wedge member 194 relative to the attachment member 191 is determined. As a result, the vehicle door may be appropriately fixed relative to the vehicle door in accordance with the frictional engagement between the wedge member 194 of the fixed wedge 168 and the movable wedge device 60 when the wedge member 194 is in contact with the receiving portion 191*d* arranged at the lowermost position in the attaching direction.

According to the aforementioned second embodiment, the attachment member 191 is configured to be attached to the vehicle body panel B or the door panel D together with the door lock assembly LA by the same bolts 96. The door lock assembly LA is engageable with the door lock striker 61 fixed to the vehicle body panel B or the door panel D at which the movable wedge device 60 is arranged.

According to the aforementioned configuration, the special attachment portion for attaching the attachment member 191 to the door panel D is not required to be provided at the door panel D. Consequently, for example, in a case where the attachment member 191 (the fixed wedge 168) is additionally attached to the door panel D after the door lock assembly LA is attached to the door panel D, the man-hours required to additionally attach the attachment member 191 to the door panel D may be reduced.

According to the aforementioned second embodiment, the fixed wedge 168 is configured to be fixed to one of the vehicle body panel B and the door panel D. The fixed wedge 168 includes the attachment member 191 configured to be attached to the vehicle body panel B or the door panel D, and the wedge member 194 provided to be pressure contactable with the movable wedge device 60 configured to be arranged at the other of the vehicle body panel B and the door panel D. The wedge member 194 attachable and removable relative to the attachment member 191 forms the design surface of the fixed wedge (168).

According to the aforementioned second embodiment, the vehicle door fixing apparatus further includes the guide mechanism guiding the wedge member 194 to be attached to and removed from the attachment member 191 along the direction that is different from the moving direction of the vehicle door relative to the vehicle body.

According to the aforementioned embodiments, the vehicle door fixing apparatus includes the fixed wedge 68, 168 fixed to one of the vehicle body panel B and the door panel D, and the movable wedge device 60 fixed to the other of the vehicle body panel B and the door panel D. The fixed wedge 68, 168 includes the attachment member 91, 191 attached to the vehicle body panel B or the door panel D, and the wedge member 92, 194 provided to be attachable and removable relative to the attachment member 91, 191 and engaging with the movable wedge device 60.

According to the aforementioned embodiments, the attachment member 91, 191 is configured to be attached to the vehicle body panel B or the door panel D together with the door lock assembly LA by the same bolts 96. The door lock assembly LA is engageable with the door lock striker 61 fixed to the vehicle body panel B or the door panel D at which the movable wedge device 60 is arranged.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A vehicle door fixing apparatus, comprising:

a fixed wedge configured to be fixed to one of a vehicle body panel and a door panel; and a wedge device configured to be fixed to the other of the vehicle body panel and the door panel, the fixed wedge including an attachment member configured to be attached to the vehicle body panel or the door panel, and a wedge member provided to be pressure contactable with the wedge device and being attachable and removable relative to the attachment member, the wedge member forming a design surface of the fixed wedge, wherein the fixed wedge includes a fixed-wedge guide rail arranged at one of the attachment member and the wedge member, and a fixed-wedge guide groove arranged at the other of the attachment member and the wedge member, the fixed-wedge guide groove slidably engaging with the fixed-wedge guide rail to guide the wedge member to be attached to and removed from the attachment member, the fixed wedge includes a first locking portion arranged at the attachment member and a second locking portion arranged at the wedge member, the second locking portion being adjacent to or in contact with the first locking portion in an attaching direction of the wedge member relative to the attachment member along a sliding direction of the fixed-wedge guide rail and the fixed-wedge guide groove in a state where the wedge member is at an attachment position relative to the attachment member, the fixed wedge includes an engagement convex portion arranged at the attachment member and an engagement recessed portion arranged at the wedge member, and in a state where the wedge member is at the attachment position relative to the attachment member, the engagement recessed portion is fitted to the engagement convex portion to restrict the wedge member from moving in a removing direction of the wedge member relative to the attachment member along the sliding direction of the fixed-wedge guide rail and the fixed-wedge guide groove.

2. The vehicle door fixing apparatus according to claim 1, wherein the attachment member is configured to be attached to the vehicle body panel or the door panel together with a door lock assembly by a same fixing member, the door lock assembly being engageable with a door lock striker fixed to the vehicle body panel or the door panel at which the wedge device is arranged.

3. A fixed wedge configured to be fixed to one of a vehicle body panel and a door panel, the fixed wedge comprising:

an attachment member configured to be attached to the vehicle body panel or the door panel;

a wedge member provided to be pressure contactable with a wedge device configured to be arranged at the other of the vehicle body panel and the door panel, the wedge member being attachable and removable relative to the attachment member and forming a design surface of the fixed wedge;

a fixed-wedge guide rail arranged at one of the attachment member and the wedge member;

a fixed-wedge guide groove arranged at the other of the attachment member and the wedge member, the fixed-wedge guide groove slidably engaging with the fixed-wedge guide rail to guide the wedge member to be attached to and removed from the attachment member;

a first locking portion arranged at the attachment member;

a second locking portion arranged at the wedge member, the second locking portion being adjacent to or in contact with the first locking portion in an attaching direction of the wedge member relative to the attachment member along a sliding direction of the fixed-wedge guide rail and the fixed-wedge guide groove in a state where the wedge member is at an attachment position relative to the attachment member;

an engagement convex portion arranged at the attachment member; and an engagement recessed portion arranged at the wedge member, wherein in a state where the wedge member is at the attachment position relative to the attachment member, the engagement recessed portion is fitted to the engagement convex portion to restrict the wedge member from moving in a removing direction of the wedge member relative to the attachment member along the sliding direction of the fixed-wedge guide rail and the fixed-wedge guide groove.

4. The fixed wedge according to claim 3, further comprising a guide mechanism guiding the wedge member to be attached to and removed from the attachment member along a direction that is different from a moving direction of a vehicle door relative to a vehicle body.

5. A vehicle door fixing apparatus, comprising:

a fixed wedge fixed to one of a vehicle body panel and a door panel; and a wedge device fixed to the other of the vehicle body panel and the door panel, the fixed wedge including an attachment member attached to the vehicle body panel or the door panel, and a wedge member provided to be attachable and removable relative to the attachment member and engaging with the wedge device, wherein the fixed wedge includes a fixed-wedge guide rail arranged at one of the attachment member and the wedge member, and a fixed-wedge guide groove arranged at the other of the attachment member and the wedge member, the fixed-wedge guide groove slidably engaging with the fixed-wedge guide rail to guide the wedge member to be attached to and removed from the attachment member, the fixed wedge includes a first locking portion arranged at the attachment member and a second locking portion arranged at the wedge member, the second locking portion being adjacent to or in contact with the first locking portion in an attaching direction of the wedge member relative to the attachment member along a sliding direction of the fixed-wedge guide rail and the fixed-wedge guide groove in a state where the wedge member is at an attachment position relative to the attachment member, the fixed wedge includes an engagement convex portion arranged at the attachment member and an engagement recessed portion arranged at the wedge member, and in a state where the wedge member is at the attachment position relative to the attachment member, the engagement recessed portion is fitted to the engagement convex portion to restrict the wedge member from moving in a removing direction of the wedge member relative to the attachment member along the sliding direction of the fixed-wedge guide rail and the fixed-wedge guide groove.

6. The vehicle door fixing apparatus according to claim 5, wherein the attachment member is configured to be attached to the vehicle body panel or the door panel together with a door lock assembly by a same fixing member, the door lock assembly being engageable with a door lock striker fixed to the vehicle body panel or the door panel at which the wedge device is arranged.

* * * * *